US008251485B2

(12) United States Patent
Yoshihisa

(10) Patent No.: US 8,251,485 B2
(45) Date of Patent: Aug. 28, 2012

(54) FLUID EJECTING APPARATUS

(75) Inventor: Sugata Yoshihisa, Sennan (JP)

(73) Assignee: Seiko Epson Corporation, Tokyo (JP)

( * ) Notice: Subject to any disclaimer, the term of this patent is extended or adjusted under 35 U.S.C. 154(b) by 311 days.

(21) Appl. No.: 12/638,041

(22) Filed: Dec. 15, 2009

(65) Prior Publication Data

US 2010/0147891 A1 Jun. 17, 2010

(30) Foreign Application Priority Data

Dec. 16, 2008 (JP) ..... 2008-320065

(51) Int. Cl.
*B41J 23/00* (2006.01)

(52) U.S. Cl. ..... 347/29

(58) Field of Classification Search ..... 347/29–32
See application file for complete search history.

(56) References Cited

U.S. PATENT DOCUMENTS 4,223,324 A * 9/1980 Yamamori et al. ..... 347/21
6,007,177 A * 12/1999 Takanaka et al. ..... 347/28
6,540,322 B2 * 4/2003 Usui et al. ..... 347/29
6,672,704 B2 * 1/2004 Katakura et al. ..... 347/23
7,887,157 B2 * 2/2011 Shimazaki ..... 347/29

FOREIGN PATENT DOCUMENTS

JP 2001-018408 1/2001

* cited by examiner

*Primary Examiner* — Charlie Peng
(74) *Attorney, Agent, or Firm* — Workman Nydegger

(57) ABSTRACT

A fluid ejecting apparatus is provided, which includes: a fluid receptor that receives fluid; a moisturizing liquid receptor that receives moisturizing liquid; a fluid ejecting head that ejects the fluid supplied from the fluid receptor from nozzles formed on a nozzle forming surface; a cap device that has a spatial region becoming airtight by an opening being covered by another member, and is capable of retaining the moisturizing liquid supplied from the moisturizing liquid receptor within the spatial region; and a pressurizing mechanism that leads out the fluid from the inside of the fluid receptor toward the fluid ejecting head and leads out the moisturizing liquid from the inside of the moisturizing liquid receptor toward the inside of the spatial region of the cap device by applying pressure to the fluid receptor and the moisturizing liquid receptor.

3 Claims, 11 Drawing Sheets

FLUID EJECTING APPARATUS

CROSS REFERENCES TO RELATED APPLICATIONS

The entire disclosure of Japanese Patent Application No. 2008-320065, filed Dec. 16, 2008 is expressly incorporated by reference herein.

BACKGROUND

1. Technical Field

The invention relates to a fluid ejecting apparatus such as, for example, an ink jet type printer.

2. Related Art

In the past, there have been known ink jet type printers (hereinafter, referred to as "printer") as a fluid ejecting apparatus which ejects fluid for a target. These printers perform printing (recording) on a paper as a target such that ink (fluid) supplied to a recording head (fluid ejecting head) is ejected from nozzles formed on the recording head.

In the printers mentioned above, when the ink is not ejected for a long period of time, the ink in the nozzles is thickened, so that the ejection accuracy is degraded. Therefore, in such a printer as disclosed in, for example, JP-A-2001-18408, nozzles forming surface of the recording head is covered by a cap (cap device), and moisturizing liquid is dropped from a moisturizing liquid tank (moisturizing liquid receptor) moving along with the recording head into the cap. That is, the inside of the cap is moisturized and evaporation of the ink from the nozzles is suppressed.

Meanwhile, since the moisturizing liquid tank is mounted in a carriage together with an ink cartridge in the case of the printer disclosed in JP-A-2001-18408, there has been required alignment by driving the carriage when the moisturizing liquid is dropped into the cap.

Further, when the moisturizing liquid tank is disposed outside the carriage, there have been required not only a large-size tank but also addition of a exclusive mechanism such as a pump in supplying the moisturizing liquid because of the difficulty of replacing the moisturizing liquid tank and replenishing the moisturizing liquid. Therefore, there has been a problem that the configuration is increased in size and complicated.

SUMMARY

An advantage of some aspects of the invention is that it provides a fluid ejecting apparatus capable of miniaturizing and simplifying, without requiring alignment of a moisturizing liquid receptor and a cap device.

According to a first aspect of the invention, a fluid ejecting apparatus is provided, which includes: a fluid receptor that receives fluid; a moisturizing liquid receptor that receives moisturizing liquid; a fluid ejecting head that ejects the fluid supplied from the fluid receptor from nozzles formed on a nozzle forming surface; a cap device that has a spatial region becoming airtight by an opening being covered by another member, and is capable of retaining the moisturizing liquid supplied from the moisturizing liquid receptor within the spatial region; and a pressurizing mechanism that leads out the fluid from the inside of the fluid receptor toward the fluid ejecting head and leads out the moisturizing liquid from the inside of the moisturizing liquid receptor toward the inside of the spatial region of the cap device by applying pressure to the fluid receptor and the moisturizing liquid receptor.

With this configuration, the pressure is applied to both of the fluid receptor and the moisturizing liquid receptor by the pressurizing mechanism, to thereby allow the fluid and the moisturizing liquid received in each one of the receptors to be supplied. That is, there is included the pressurizing mechanism that leads out the moisturizing liquid from the moisturizing liquid receptor toward the spatial region of the cap device, so that alignment of the moisturizing liquid receptor and the cap device becomes unnecessary, and thereby it becomes possible to supply the moisturizing liquid regardless of the position relationship thereof. Therefore, for example, it is possible to supply the moisturizing liquid with maintaining the state where the cap device covers the nozzle forming surface. The pressurizing mechanism that leads out the fluid within the fluid receptor toward the fluid ejecting head further includes a mechanism to lead out the moisturizing liquid. Therefore, the mechanism to lead out the moisturizing liquid does not need to be included individually, to thereby allow the configuration to be miniaturized and simplified.

In the fluid ejecting apparatus of the invention, it is preferable that an overflow hole making the moisturizing liquid flow out to the outside of the cap device is formed in the cap device, when a liquid level of the moisturizing liquid retained within the spatial region becomes equal to or greater than the height of a predetermined threshold liquid level on the basis of the supply from the moisturizing liquid receptor.

With this configuration, the moisturizing liquid supplied into the spatial region of the cap device flows out from the overflow hole to the outside of the cap device, when it becomes equal to or greater than the height of the threshold liquid level. Therefore, it is possible to make a constant amount of the moisturizing liquid remain within the cap device with the simple configuration. Furthermore, it is possible to suppress the overflow of the moisturizing liquid from the opening of the cap device. That is, it is possible to easily recover the moisturizing liquid by forming the outflow path of the extra moisturizing liquid, and suppress contamination in the fluid ejecting apparatus.

In the fluid ejecting apparatus of the invention, it is preferable to include a moisturizing liquid supply channel capable of supplying the moisturizing liquid from the moisturizing liquid receptor into the spatial region. Further, a moisturizing liquid discharge channel is branched off from midway in the moisturizing liquid supply channel, and the downstream end of the moisturizing liquid discharge channel communicates with the overflow hole.

With this configuration, since the moisturizing liquid supply channel supplies the moisturizing liquid into the spatial region of the cap device, it communicates with the spatial region. Further, since the moisturizing liquid discharge channel is branched off from midway in the moisturizing liquid supply channel, it communicates with the spatial region of the cap device via the moisturizing liquid supply channel. Therefore, the moisturizing liquid supplied from the moisturizing liquid supply channel is discharged via the moisturizing liquid discharge channel, if the height of the moisturizing liquid supplied into the spatial region of the cap device is equal to or greater than the height position corresponding to the overflow hole. Therefore, it is possible to suppress the overflow of the moisturizing liquid from the cap device, and make a constant amount of the moisturizing liquid remain within the cap device. In addition, since the spatial region of the cap device is blocked from the atmosphere by the moisturizing liquid remaining within the moisturizing liquid supply channel and the moisturizing liquid discharge channel, it is possible to improve the moisturizing efficiency by raising a degree of air-tightness thereof.

In the fluid ejecting apparatus of the invention, it is preferable that a maintenance device that maintains the fluid ejecting head is received in the cap device in a disposition state where it is enclosed in the spatial region, when the opening of the cap device is covered by the another member.

With this configuration, since the maintenance device is provided in the spatial region covered by the cap device to which the moisturizing liquid is supplied and another member, it is possible to moisturize the maintenance device. Therefore, it is possible to suppress drying of the fluid attached to the maintenance device, and suppress contamination of the fluid ejecting head which is involved with the attachment of the dried and thickened fluid to the fluid ejecting head.

In the fluid ejecting apparatus of the invention, it is preferable that the cap device includes a first cap device having a spatial region that becomes airtight by the opening being covered by the fluid ejecting head or a support supporting the fluid ejecting head, and a second cap device that has a spatial region becoming airtight by the opening being covered by the first cap device, and the maintenance device is received in the spatial region of the second cap device.

With this configuration, the first cap device can moisturize the fluid ejecting head by the opening being covered by the fluid ejecting head or the support supporting the fluid ejecting head in a disposition state where the opening surrounds the nozzles of the nozzle forming surface. In addition, since the opening is covered by the first cap device, it is possible for the second cap device to suppress drying of the maintenance device received in the spatial region of the second cap device. When a plurality of cap devices is provided, the opening of the cap device is covered by other cap device, so that it becomes possible to make the inside of the cap device be airtight without separately providing other members covering the opening, to thereby allow the configuration of the fluid ejecting apparatus to be simplified.

In the fluid ejecting apparatus of the invention, it is preferable that the cap device further includes an atmosphere opening hole that makes an atmosphere and the spatial region becoming airtight by the opening be covered by the another member communicate with each other, and an atmosphere opening valve that blocks the atmosphere opening hole to switch the communication between the spatial region and the atmosphere. The atmosphere opening valve is in an open valve state where the spatial region and the atmosphere are allowed to communicate with each other when the moisturizing liquid is supplied to the cap device by applying pressure to the moisturizing liquid receptor by the pressurizing mechanism, and is in a closed valve state where the spatial region and the atmosphere are blocked when the moisturizing liquid is not supplied.

With this configuration, the spatial region of the cap device is in the open valve state of the atmosphere opening valve at the supply time of the moisturizing liquid even though it is kept airtight by the opening being covered by other members. For this reason, the gas in the cap device, which has pressure raised by the supply of the moisturizing liquid, is discharged through the atmosphere opening hole. Therefore, it is possible to suppress a rise in the internal pressure and to thereby easily supply the moisturizing liquid. Furthermore, since the atmosphere opening valve is in the closed valve state at the no supply time of the moisturizing liquid, it is possible to suppress evaporation of the moisturizing liquid to the outside of the cap device through the atmosphere opening hole.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
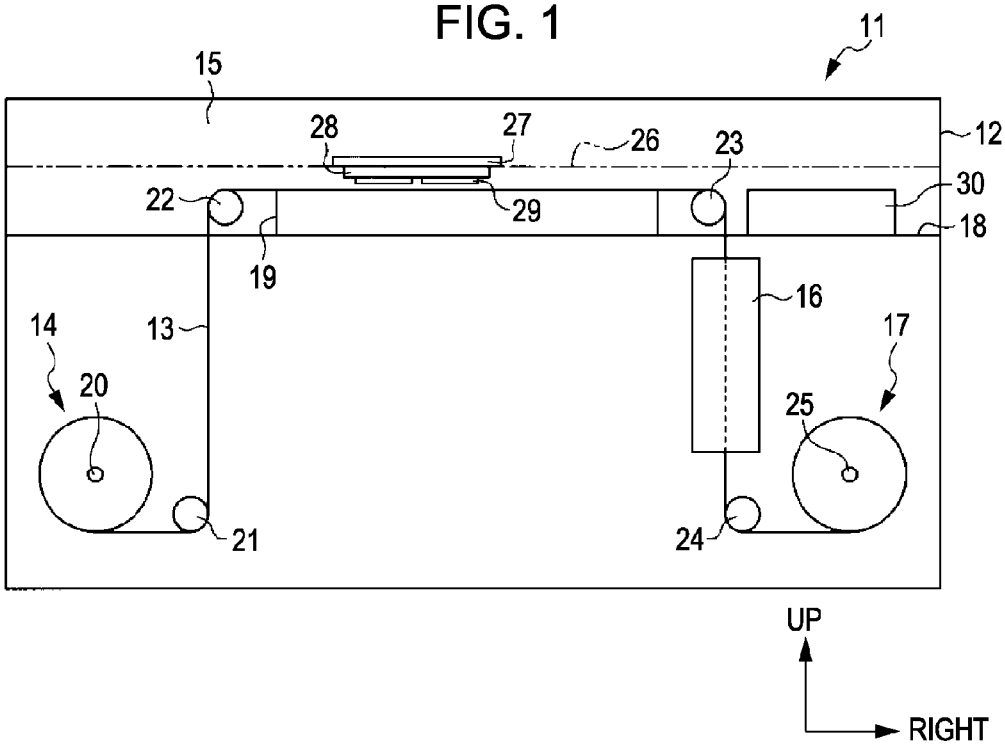
FIG. 1 is a schematic front view of a printer of the embodiment.

Hereinafter, an embodiment will be described with reference to FIGS. 1 to 14, in which the invention is specified as an ink jet type printer. Further, in the following description of the specification, "front-back direction", "horizontal direction", and "vertical direction" are assumed to show directions on the basis of the direction shown by the arrow in the drawings of FIG. 1 and the like.

As shown in FIG. 1, the ink jet type printer (hereinafter, referred to as "printer") 11 as the fluid ejecting apparatus is provided with a body case 12 in a rectangular parallelepiped shape. In the body case 12, there is provided a reel-out portion 14 for reeling out a continuous sheet 13 as an elongated target, a printing chamber 15 for performing the printing by ejection of the ink as a fluid on the continuous sheet 13, a drying device 16 for performing drying treatment on the continuous sheet 13 on which the ink is attached by the printing, and a winding portion 17 for winding the continuous sheet 13 which is subjected to the drying treatment as described above.

That is, a tabular base 18 is provided in a position slightly higher than the center portion in the vertical direction in the body case 12, which vertically partitions the inside of the body case 12. The upper region of the base 18 serves as the printing chamber 15 which is configured to support a rectangular plate-shaped platen 19 on the base 18. Then, in the lower region of the base 18, the reel-out portion 14 is arranged in a position close to the left side which becomes an upstream side in the transport direction of the continuous sheet 13, and the drying device 16 and the winding portion 17 are arranged in a position close to the right side which becomes a downstream.

As shown in FIG. 1, a winding shaft 20 is provided on the reel-out portion 14 so as to rotate freely. The continuous sheet 13 is supported so as to rotate integrally with the winding shaft 20 in a state where the continuous sheet 13 is wound in a roll shape with respect to the winding shaft 20 in advance.

That is, the continuous sheet 13 is reeled out from the reel-out portion 14, as the winding shaft 20 rotates, so as to be transported to the downstream side. In addition, a first roller 21 is provided on the right side of the reel-out portion 14. The first roller 21 is provided to extend in a front-back direction in a state parallel to the winding shaft 20, and converts the transport direction of the continuous sheet 13 to the vertically upward direction by winding the right lower side of the continuous sheet 13 which is reeled out from the winding shaft 20.

On the other hand, in the printing chamber 15, a second roller 22 is provided on a position which corresponds to the left side of the platen 19 and to the first roller 21 in the vertical direction in a state parallel to the first roller 21 which is provided on the lower side thereof. Then, the continuous sheet 13 of which the transport direction is converted to the vertically upward direction by the first roller 21 is wound from its left lower side by the second roller 22, so that the transport direction is converted to the horizontal direction and the continuous sheet 13 comes into slidingly contactable with the upper surface of the platen 19.

In addition, a third roller 23 is provided on the right side of the platen 19 in the printing chamber 15, which interposes the platen 19 with the second roller 22 on the left side and faces the second roller 22 in the horizontal direction. The third roller 23 is provided to extend in the front-back direction in a state parallel to the second roller 22. Further, the positions of the second roller 22 and the third roller 23 are adjusted such that the top surfaces of the peripheral planes thereof become the same height as the upper surface of the platen 19.

Therefore, the continuous sheet 13 of which the transport direction is converted to the horizontally right direction by the second roller 22 on the left side in the printing chamber 15 is transported to the right side which becomes the downstream while coming into slidingly contactable with the upper surface of the platen 19. Thereafter, the third roller 23 winds the continuous sheet 13 from its right upper side, so that the transport direction of the continuous sheet 13 is converted to the vertically downward direction so as to be transported to the drying device 16 which is disposed on the lower side from the base 18. Then, the continuous sheet 13 passes through the drying device 16 and is subjected to the drying treatment. Then, the continuous sheet 13 is further transported in the vertically downward direction.

As shown in FIG. 1, a fourth roller 24 is provided on the lower side of the drying device 16, which extends in the front-back direction. The fourth roller 24 winds the continuous sheet 13 which passes through the drying device 16 and is transported in the vertically downward direction, so that the transport direction of the continuous sheet 13 is converted to the horizontally right direction. The winding portion 17 is arranged on the right side of the fourth roller 24. Then, a winding shaft 25 is provided in the winding portion 17, which extends in the front-back direction in a state parallel to the fourth roller 24. The winding shaft 25 rotates on the basis of driving force of a transport motor (not shown), so that the tip end of the continuous sheet 13, which becomes the downstream end in the transport direction of the continuous sheet 13 with respect to the winding shaft 25, is wound.

As shown in FIG. 1, guide rails 26 (which are marked with a double-dashed line in FIG. 1) are provided to form a pair with each other on both the front and back sides of the platen 19 in the printing chamber 15, which extends in the horizontal direction. The upper surface of the guide rail 26 is formed higher than the upper surface of the platen 19. On the upper surface of both the guide rails 26, the rectangular carriage 27 is supported in a state where the carriage 27 can reciprocally move in the horizontal direction along both the guide rails 26 on the basis of the driving of a driving mechanism (not shown). Then, on the lower surface side of the carriage 27, recording heads 29 as the fluid ejecting heads are supported via a support plate 28 as a support body.

In the printing chamber 15, a predetermined range from the left end to the right end of the platen 19 becomes a printing region, and the continuous sheet 13 is intermittently transported in the unit of printing region. Then, the ink is ejected from the recording head 29 in accordance with reciprocating the carriage 27 with respect to the continuous sheet 13 in a stop state on the platen 19 by the intermittent transport in the unit of printing region, so that the printing is performed on the continuous sheet 13. In addition, a maintenance mechanism 30 is provided in a non-printing region which is disposed on the right side from the third roller 23 in the printing chamber 15. The maintenance mechanism 30 is provided to carry out maintenance on the recording head 29 in non-printing.

Figure 2:
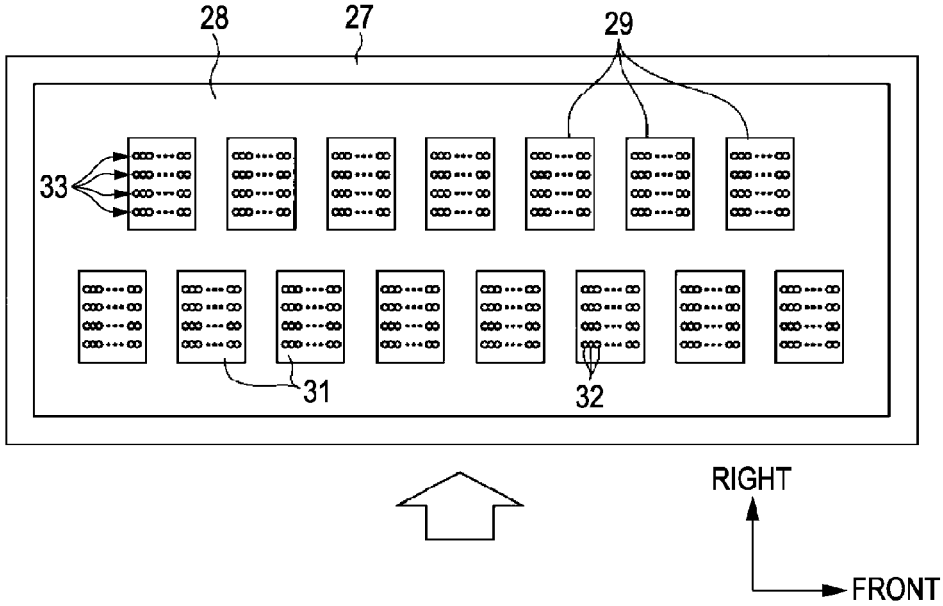
FIG. 2 is a schematic diagram showing nozzle forming surfaces of recording heads.

As shown in FIG. 2, a plurality of recording heads 29 (15 pieces in this embodiment) are supported on the support plate 28 which is supported on the lower surface side of the carriage 27. The recording heads 29 are supported so as to dispose in a zigzag shape along the width direction (front-back direction) perpendicular to the transport direction (which is a direction marked with the white arrow omission in FIG. 2) of the continuous sheet 13. Then, in the nozzle forming surface 31 which becomes the lower surface of each recording head 29, a large number of the nozzles 32 are arranged along the front-back direction so as to form a plurality of nozzle rows 33 (4 rows in this embodiment) which are regularly formed at a predetermined interval in the horizontal direction.

Figure 3:
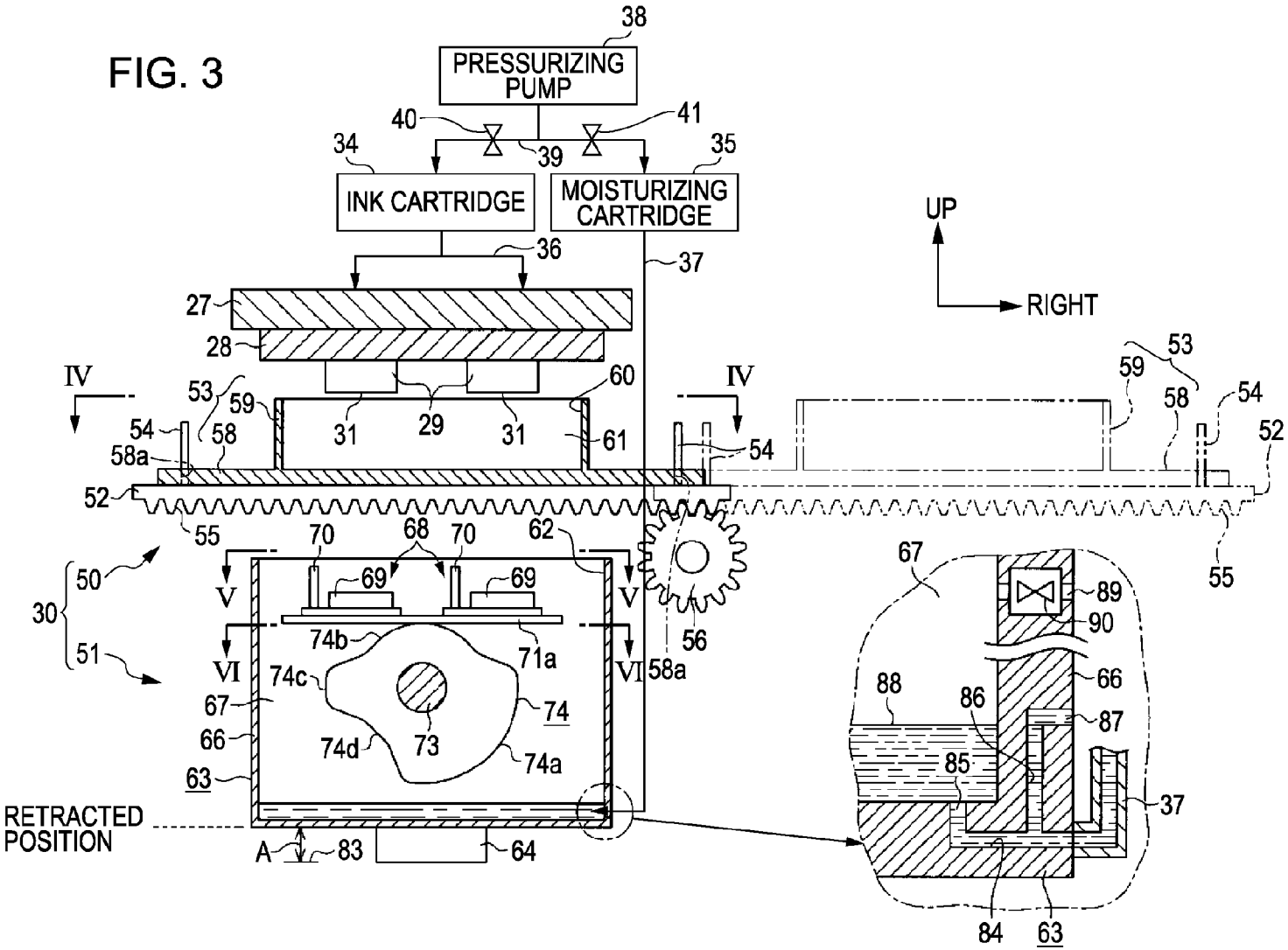
FIG. 3 is a schematic diagram of a maintenance mechanism.

In addition, as shown in FIG. 3, a plurality of ink cartridges 34 (4 pieces in this embodiment, but in this case, only 1 piece is shown in FIG. 3) used as the fluid receptors, which receive ink having different colors, and a moisturizing liquid cartridge 35 used as a moisturizing liquid receptor, which receives a moisturizing liquid including glycerin and the like, are removably mounted in the body case 12. Then, each of the ink cartridges 34 is connected to the recording head 29 via an ink support tube 36. On the other hand, the moisturizing liquid cartridge 35 is connected to the maintenance mechanism 30 via a moisturizing liquid supply tube 37 constituting a moisturizing liquid supply channel.

Furthermore, as shown in FIG. 3, a pressurizing pump 38 as a pressurizing mechanism is provided in the body case 12. The pressurizing pump 38 is connected to the upstream end of an air supply tube 39 of which the downstream side is branched so as to be pluralized. The each downstream end of the air supply tube 39 is connected to each ink cartridge 34 and the moisturizing liquid cartridge 35. In addition, an ink supply valve 40 is provided in a tube portion to which the downstream end is connected to the ink cartridge 34 in the tube portion of the downstream side from the branched position of the air supply tube 39. Further, a moisturizing liquid supply valve 41 is provided in a tube portion to which the downstream end is connected to the moisturizing liquid cartridge 35.

In a state where the ink supply valve 40 is opened, pressurized air is supplied to each ink cartridge 34 via the air supply tube 39 from the pressurizing pump 38, so that the ink is led out to the recording head 29 via the ink supply tube 36 from each ink cartridge 34. In addition, in a state where the moisturizing liquid supply valve 41 is opened, the pressurized air is supplied to the moisturizing liquid cartridge 35 via the air supply tube 39 from the pressurizing pump 38, so that the moisturizing liquid is led out to the maintenance mechanism 30 via the moisturizing liquid supply tube 37 from the moisturizing liquid cartridge 35.

Next, the maintenance mechanism 30 will be described.

As shown in FIG. 3, the maintenance mechanism 30 includes a moisturizing unit 50 that is disposed movably in the horizontal direction in a position that is lower than the recording head 29 in the non-printing region; and a maintenance unit 51 that is disposed movably in the vertical direction in a position that is further lower than the moisturizing unit 50. As shown in the same drawing, the maintenance mechanism 30 is configured to be capable of assume a disposition state where the moisturizing unit 50 and the maintenance unit 51 are overlapped in the vertical direction by the movement position of the moisturizing unit 50 in the horizontal direction.

Figure 4:
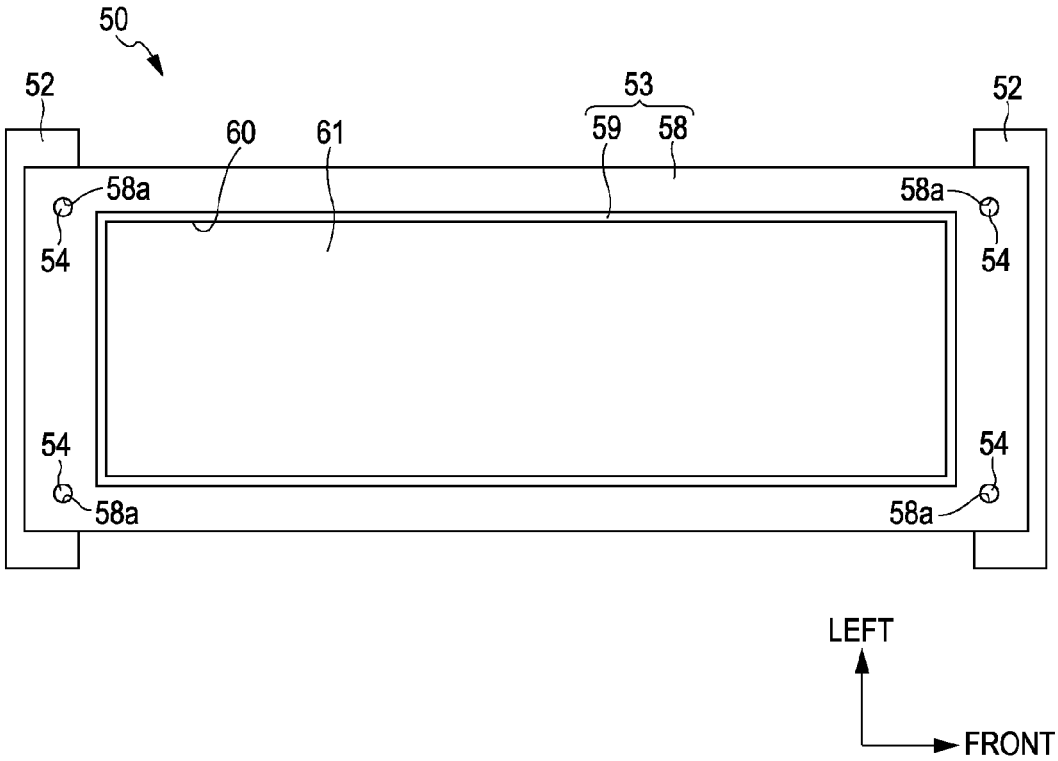
FIG. 4 is a schematic plan view of a moisturizing unit taken along the line IV-IV of FIG. 3.

As shown in FIG. 3 and FIG. 4, the moisturizing unit 50 is configured to have, as main constituents, a pair of front and back belt-like plates 52 that have longer dimension in the horizontal direction that becomes the length direction, rather than the dimension in the horizontal direction of the support plate 28 supporting each recording head 29; and a moisturizing cap 53 as the first cap device that is supportable on both of the belt-like plates 52. On each of the left and right ends of each belt-like plate 52, a guide rod 54 is disposed upright as a guide portion vertically upward. On the lower surface of each belt-like plate 52, racks 55 are formed along the horizontal direction. For the racks 55 of each the belt-like plate 52, a pinion 56 is engaged, which rotates around the axial line along the front-back direction in the right position that is the opposite side of the printing region when viewed from the maintenance unit 51.

To this pinion 56, a movement motor 57 (see FIG. 9) is linked power-transmittably, which controls the rotation in both of the forward and reverse directions. By rotation of the pinion 56 with the driving of this movement motor 57, the pair of front and back belt-like plates 52, with which the pinion 56 and the racks 55 are engaged, is configured to reciprocate between the interference position shown with the solid line in FIG. 3 and the non-interference position shown with the double-dashed line in FIG. 3, which is separated from the interference position in the right side in the horizontal direction, with maintaining the horizontal state.

In addition, the moisturizing cap 53 has a substrate portion 58 that is formed in a rectangular shape, which is bigger than the support plate 28 in the shape of the planar view. From the upper surface of the substrate portion 58, a peripheral wall portion 59 is protrusively formed upward, which forms rectangular circularity that is smaller than the margin shape of the support plate 28, and bigger than the position region of each recording head 29 disposed in a zigzag shape. The moisturizing cap 53 is configured such that a spatial region 61 in the peripheral wall portion 59 is kept airtight in a case where an opening 60 of the peripheral wall portion 59 is covered with the support plate 28 by bringing the upper end of the peripheral wall portion 59 into contact with the support plate 28 that is another member to surround all of the recording heads 29 collectively. Therefore, a seal member, which is not shown and composed of an elastic material, is provided in a rectangular circularity on the upper end of the peripheral wall portion 59 in the moisturizing cap 53.

In addition, in the four corners of the substrate portion 58 in the moisturizing cap 53, guide holes 58*a* are formed, through which each of the guide rods 54 disposed upright from the belt-like plate 52 can be inserted. By inserting the guide rods 54 of the belt-like plates 52 through these guide holes 58*a*, the moisturizing cap 53 is supported on the belt-like plate 52 in the installed state where moving in the horizontal direction is regulated. Therefore, in a case where the belt-like plate 52, which engages the racks 55 with the pinion 56, reciprocates in the horizontal direction with the driving of the movement motor 57, the moisturizing cap 53 reciprocates along with the belt-like plate 52 between the interference position and the non-interference position in the horizontal direction. With this point, in the embodiment, the first cap device transfer mechanism is constituted, in which the moisturizing cap 53 as the first cap device is moved between the interference position and the non-interference position by the movement motor 57, the pinion 56, the racks 55 and the belt-like plates 52.

On the other hand, the maintenance unit 51 includes a supporting member shaped like a box with a bottom in which the size of the opening 62 forming the rectangular shape is formed to be smaller than that of the substrate portion 58 of the moisturizing cap 53; and a maintenance cap 63 as a second cap device. This maintenance cap 63 is constituted to be supported movably to the vertical direction in the downward position of the home position of the recording head 29 in the non-printing region, and to move to the vertical direction on the basis of the driving of the elevating device 64 composed of a cylinder and the like as a simultaneous transfer mechanism.

Figure 13:
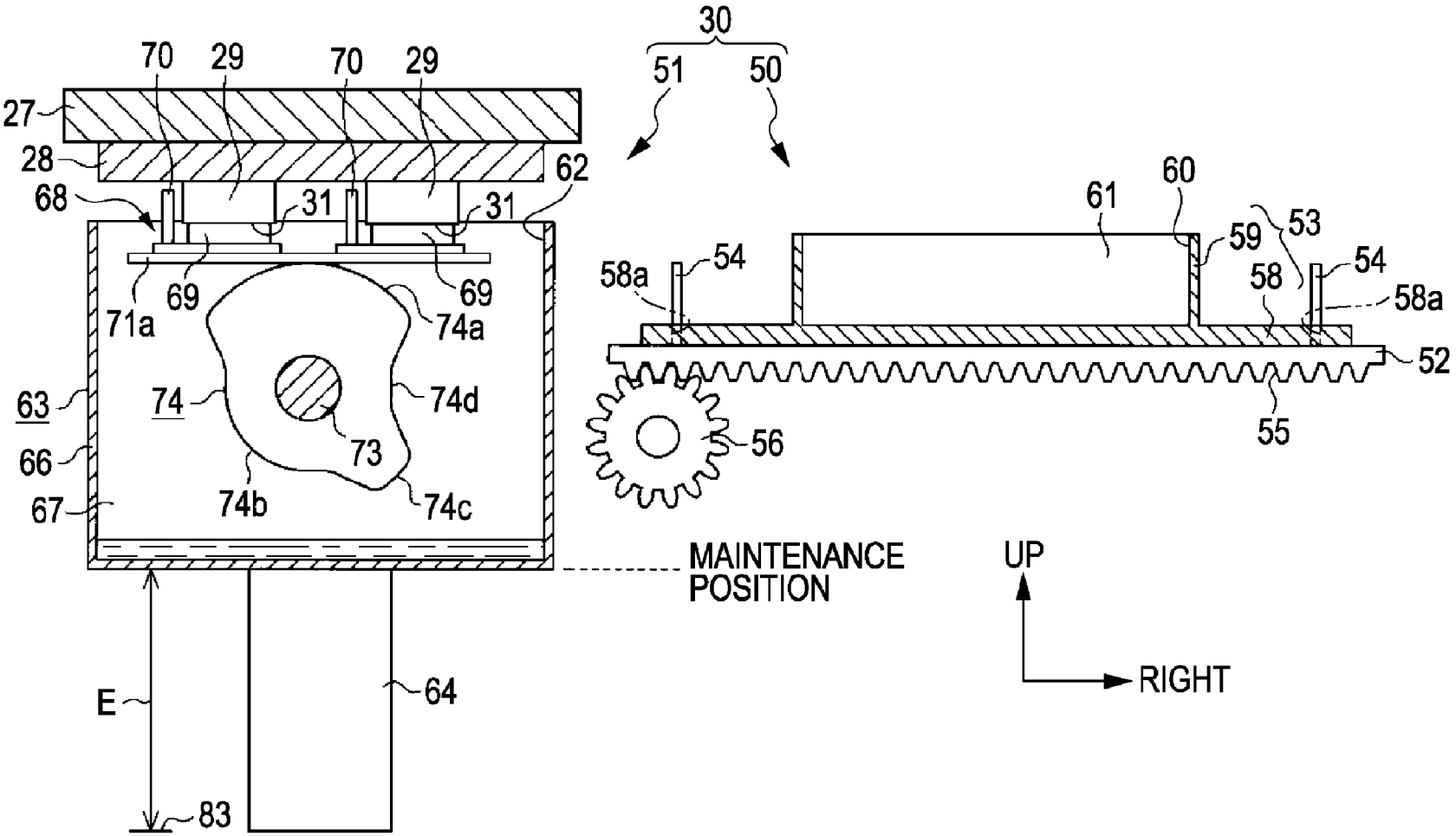
FIG. 13 is an operational explanatory diagram of the maintenance mechanism when the printer performs cleaning.

That is, the maintenance cap 63 moves to the vertical direction on the basis of the driving of the elevating device 64, between the maintenance position where each of a plurality of maintenance devices 68 described below is in the position state of approaching the corresponding recording head 29 as shown in FIG. 13, and the retracted position where each of the maintenance devices 68 is in the position state of being greatly separated downward from each corresponding recording head 29 as shown in FIG. 3. Meanwhile, the height position of the maintenance cap 63 in the vertical direction in this case is detected by an elevating sensor 65 composed of a linear potentiometer and the like (see FIG. 9).

The maintenance cap 63 is configured such that the spatial region 67 in the peripheral wall portion 66 is kept airtight in a case where the opening 62 is covered by the moisturizing cap 53 that is another member by bringing the upper end of the peripheral wall portion 66 into contact with the substrate portion 58 of the moisturizing cap 53. Therefore, a seal member (not shown) composed of an elastic material is also provided in a rectangular circularity on the upper end of the peripheral wall portion 66 in the maintenance cap 63.

In addition, as shown in FIG. 3, a moisturizing liquid flow channel 84, to which the downstream end of the moisturizing liquid supply tube 37 is connected to be capable of supplying the moisturizing liquid, is formed on the lower end of the maintenance cap 63 to pass through the inside of the bottom wall portion from the lower end of the outside surface of the peripheral wall portion 66, and to open a supply port 85 to the internal bottom surface of the maintenance cap 63. The moisturizing liquid flow channel 84 constitutes the moisturizing liquid supply channel along with the moisturizing liquid supply tube 37. From midway in the moisturizing liquid flow channel 84, a moisturizing liquid discharge channel 86 is formed as branched off to elongate upward vertically in the inside of the peripheral wall portion 66.

This moisturizing liquid discharge channel 86 is configured such that the lower end thereof is connected to the horizontally flow channel part of the moisturizing liquid flow channel 84, and the upper end thereof is horizontally flexed towards the external side of the peripheral wall portion 66 at a position that is further higher than the supply port 85, which is in an uppermost position in the moisturizing liquid flow channel 84, to thereby form an opening of a discharge port 87 as an overflow hole on the external side of the peripheral wall portion 66. Therefore, the moisturizing liquid, which is supplied to the inside of the maintenance cap 63 through the moisturizing liquid supply tube 37 and the moisturizing liquid flow channel 84 on the basis of the driving of the pressurizing pump 38 from the moisturizing liquid cartridge 35, is discharged to the outside of the maintenance cap 63 from the discharge port 87 of the moisturizing liquid discharge channel 86 by the water head difference, in a case where the liquid level 88 becomes the liquid level (the threshold liquid level) of the same height to that of the opening position of the discharge port 87 (for example, the height of about 1 to 2 mm from the internal bottom surface).

In addition, as shown in FIG. 3, an atmosphere opening hole 89, which allows the internal and the external sides of the maintenance cap 63 to communicate with each other, is formed through in the upper position rather than the discharge port 87 in the peripheral wall portion 66 of the maintenance cap 63. In the inside of the atmosphere opening hole 89, an atmosphere opening valve 90 composed of an electromagnetic valve is arranged. This atmosphere opening valve 90 is controlled in opening and closing by the control section 91 so as to be opened when the moisturizing liquid is supplied to the spatial region 67 in the maintenance cap 63, in a state where the opening 62 of the maintenance cap 63 is covered by the moisturizing cap 53 that is another member.

Figure 5:
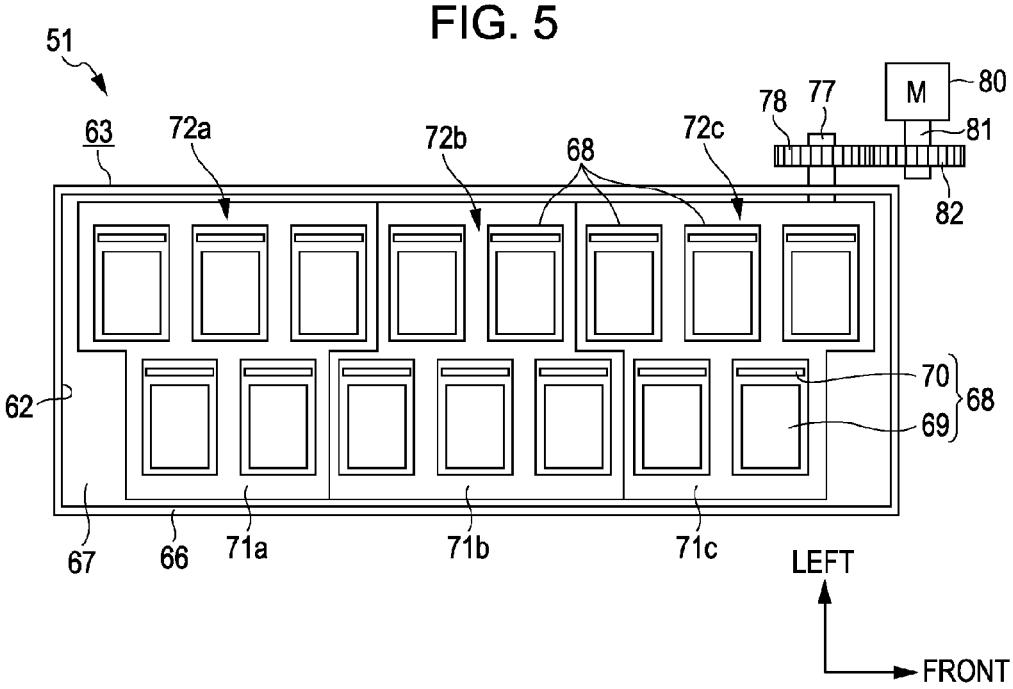
FIG. 5 is a schematic plan view of the maintenance unit taken along the line V-V of FIG. 3.

As shown in FIG. 3 and FIG. 5, maintenance devices 68, which are the same in number (15 pieces in the embodiment) as that of the recording head 29 supported by the support plate 28 of the carriage 27, are received in the inside of the maintenance cap 63 to be the position state corresponding individually to each recording head 29. Each maintenance device 68 is configured to have, as main constituents, a cap member 69 shaped like a box with a bottom, which is formed so as to come into contact with the nozzle forming surface 31 of the corresponding recording head 29 with surrounding all of the nozzle rows 33; and a wiper member 70 composed of slidingly contactable elastic pieces with flexible deformation for the nozzle forming surface 31 of the corresponding recording head 29.

Figure 9:
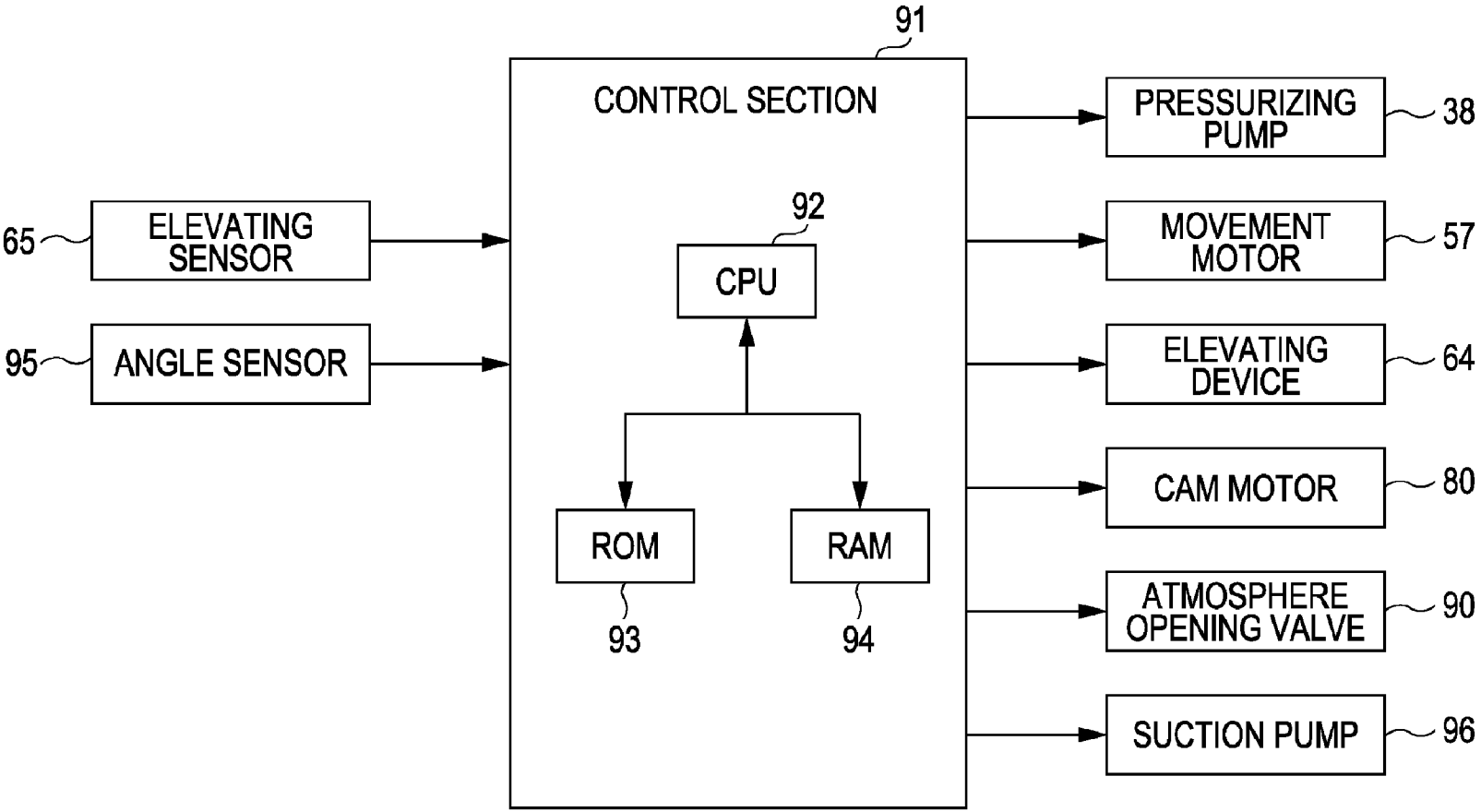
FIG. 9 is a block diagram of a control configuration.

To the cap member 69, an ink discharge tube (not shown) is connected through a suction pump 96 (see FIG. 9). The cap member 69 is configured to forcibly discharges ink that is thickened from the inside of the recording head 29 and the like to a waste ink tank (not shown) through an ink discharge tube by the driving of the suction pump 96, in a state where the opening of the upper end comes into contact with the nozzle forming surface 31 of the corresponding recording head 29 to surround all of the nozzle rows 33. In addition, the wiper member 70 is configured to sweep away ink that is attached to the nozzle forming surface 31 by bringing the upper end into sliding contact with the nozzle forming surface 31 of the corresponding recording head 29 with elastic deformation.

As shown in FIG. 5, in the inside of the maintenance cap 63, movable plates 71*a* to 71*c*, which have different width dimensions to the front-back direction in the right half and the left half, and briefly T-shaped in a plural number (three in the embodiment), are arranged movably respectively to the vertical direction in a manner such that the directions between the movable plates 71*a* to 71*c* adjacent to each other in the front-back direction cross each other. Each maintenance device 68 for each of these movable plates 71*a* to 71*c* is distributed to every one of the maintenance device groups 72*a* to 72*c*, which are constituted with the maintenance devices 68 that are in a series of the zigzag-like arrangement in the front-back direction in a predetermined number (five in the embodiment), and supported on the movable plates 71*a* to 71*c* corresponding with the unit of the maintenance device groups 72*a* to 72*c*.

That is, as shown in FIG. 5, the first maintenance device group 72*a* composed of five maintenance devices 68 forming the zigzag-like arrangement at the backward position in the maintenance cap 63, is supported by the first movable plate 71*a* located at the backmost portion in the front-back direction. In addition, the second maintenance device group 72*b* composed of five maintenance devices 68 forming the zigzag-like arrangement at the middle position in the maintenance cap 63, is supported by the second movable plate 71*b* located at the central portion in the front-back direction. Furthermore, the third maintenance device group 72*c* composed of five maintenance devices 68 forming the zigzag-like arrangement at the forward position in the maintenance cap 63, is supported by the third movable plate 71*c* located at the foremost portion in the front-back direction.

Figure 6:
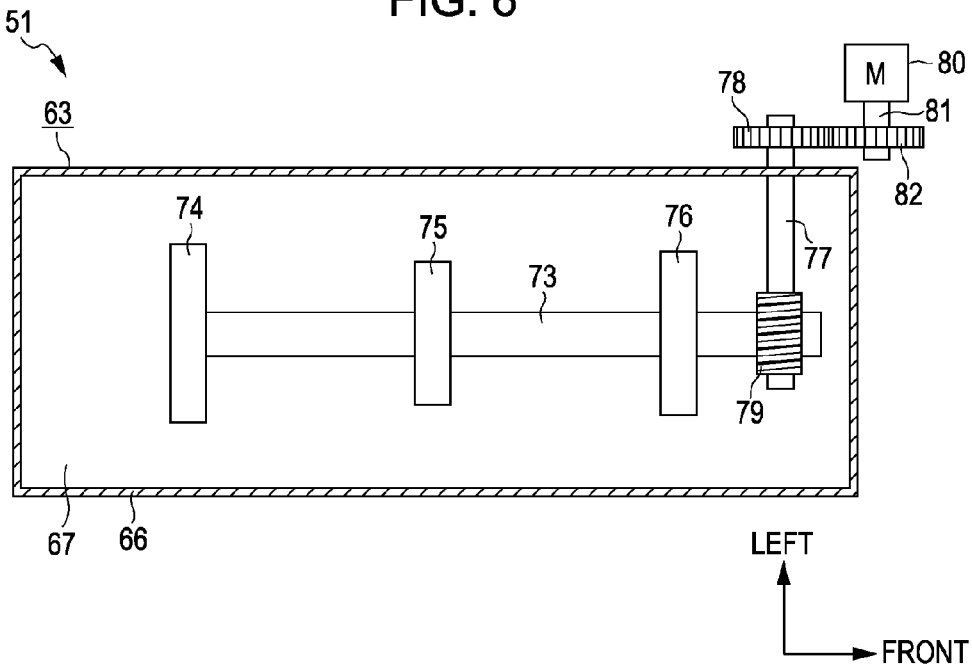
FIG. 6 is a schematic cross-section view of the maintenance unit taken along the line VI-VI of FIG. 3.

As shown in FIG. 3 and FIG. 6, one rotary shaft 73, which elongates in the front-back direction, is supported rotatably by a bearing (not shown) in the lower side rather than the movable plates 71*a* to 71*c* in the maintenance cap 63. A plurality (three in the embodiment) of cam members 74 to 76 are axially supported by the rotary shaft 73 to be rotatable integrally with the rotary shaft 73 in the front-back direction with clearance. Meanwhile, as shown in FIG. 3, the rotary shaft 73 supports the cam members 74 to 76 to the height where each of the cam members 74 to 76 can be located in the upper side rather than the liquid level 88 of the moisturizing liquid, even in a case where the liquid level 88 of the moisturizing liquid supplied to and retained in the maintenance cap 63 becomes the height of the threshold liquid level (the height corresponding to the discharge port 87 as an overflow hole). In the embodiment, a displacement member is constituted that performs displacement operation in order to move each maintenance device 68 to every one of the maintenance device groups 72*a* to 72*c* by such rotary shaft 73 and each of the cam members 74 to 76.

Figure 7A:
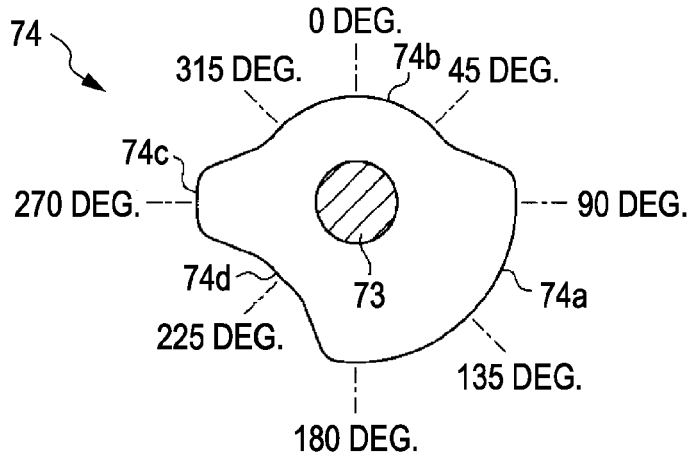
FIGS. 7A to 7C are side views showing cam shapes of each of the cam members.
Figure 7B:
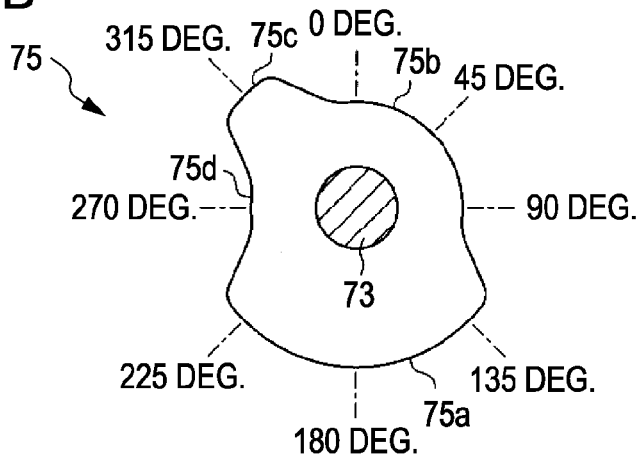
Figure 7C:
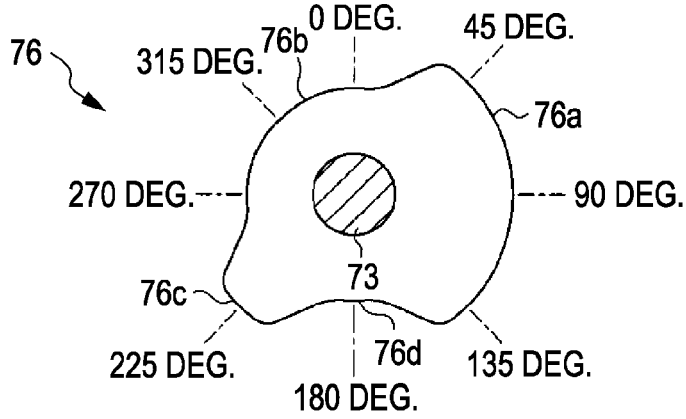
Figure 8:
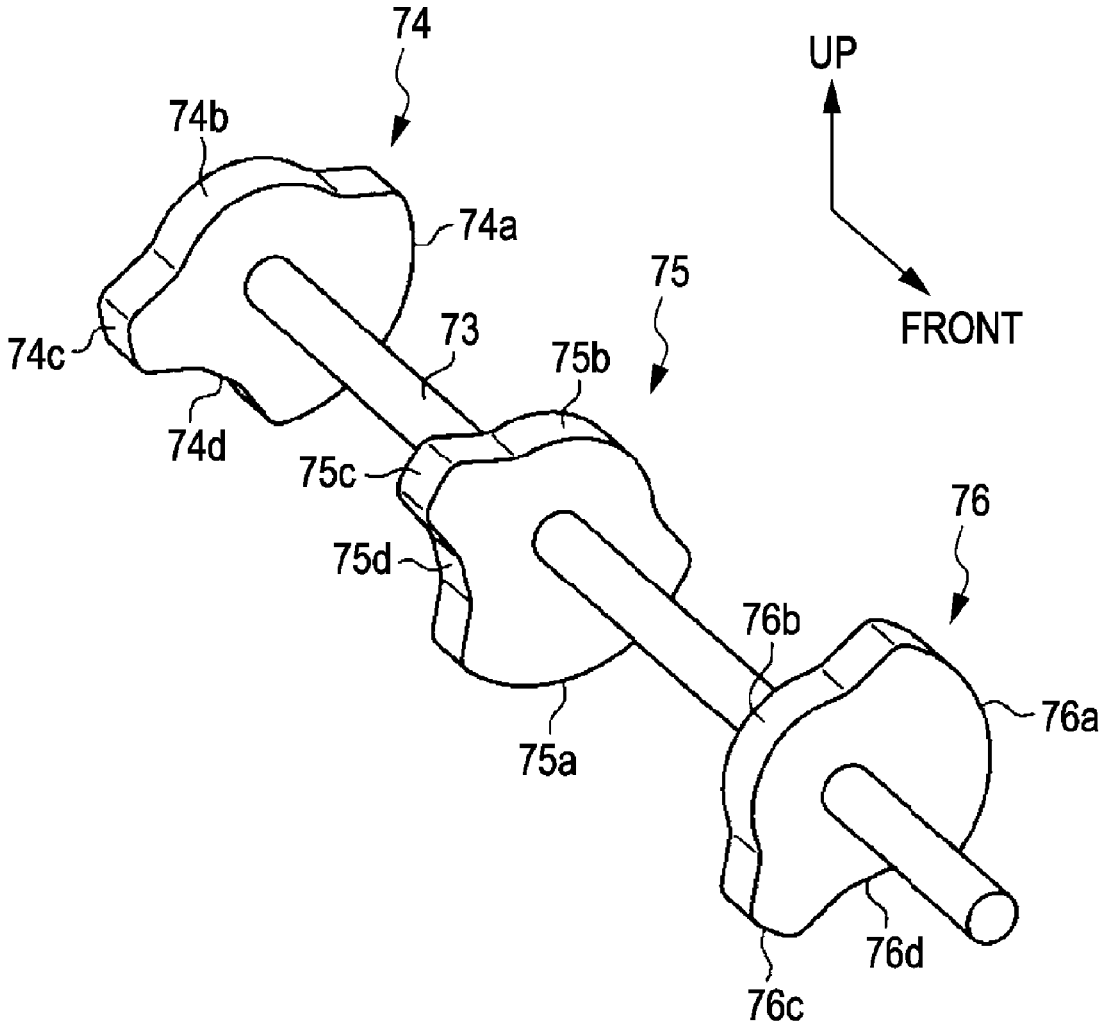
FIG. 8 is a perspective view of a displacement member constituted by the cam members and a rotary shaft.

That is, each of the cam members 74 to 76 is axially supported by the rotary shaft 73 so as to be in the disposition state individually corresponding in the vertical direction to each of the movable plates 71*a* to 71*c* that supports each of the maintenance device groups 72*a* to 72*c*, and is configured to cam-engage with the corresponding movable plates 71*a* to 71*c* from the lower side with rotation of the rotary shaft 73. Incidentally, the first cam member 74 shown in FIG. 7A is disposed in the lower side of the first movable plate 71*a* of the backmost portion; the second cam member 75 shown in FIG. 7B is disposed in the lower side of the second movable plate 71*b* of the central portion; and the third cam member 76 shown in FIG. 7C is disposed in the lower side of the third movable plate 71*c* of the foremost portion, respectively in the state of being axially supported by the rotary shaft 73.

In addition, as shown in FIG. 6, one power transmission shaft 77 that elongates in the horizontal direction is rotatably supported by a bearing (not shown) in the foremost portion in the maintenance cap 63, in a disposition state where the left end is projected to the outside of the maintenance cap 63, and the right end is orthogonal to the front end of the rotary shaft 73 from the upper side. On the left end (i.e., the projection end) that is projected to the outside of the maintenance cap 63 in the power transmission shaft 77, a driven gear 78 as a gear of the rotary shaft side is axially supported to be rotatable integrally with the power transmission shaft 77. On the other hand, on the right end of the power transmission shaft 77, a worm 79, which engages with a worm wheel (not shown)

axially supported by the front end of the rotary shaft 73, is provided to be rotatable integrally with the power transmission shaft 77.

In addition, as shown in FIG. 6, in the position close to the left end (the projection end) of the power transmission shaft 77 in the external side of the maintenance cap 63, a cam motor 80 is disposed as a driving source such that the output shaft 81 is along the horizontal direction as parallel to the power transmission shaft 77. On the apex of the output shaft 81 of the cam motor 80, a driving gear 82, which has the engagement relationship with the driven gear 78 of the side of the power transmission shaft 77 and constitutes the power transmission gear mechanism, is axially supported as a gear in the driving source side to be rotatable integrally with the output shaft 81.

Herein, as shown in FIG. 3, the driving gear 82, which is axially supported by the apex of the output shaft 81 in the cam motor 80, is capable of engaging with the driven gear 78 of the power transmission shaft 77 in a case where the maintenance cap 63 is in the state of the lowest retracted position where the bottom surface thereof is upward located by the distance A from predetermined reference plane 83 on the basis of the driving of the elevating device 64. That is, in a case where the maintenance cap 63 moves upward more than the retracted position state shown in FIG. 3 on the basis of the driving of the elevating device 64, the power transmission shaft 77 axially supporting the driven gear 78 on the projection end thereof also ascends along with the maintenance cap 63. On the other hand, the cam motor 80 axially supporting the driving gear 82 by the output shaft 81 is fixably disposed in the proximity of the reference plane 83, and the height of the driving gear 82 has no change. Therefore, in a case where the maintenance cap 63 moves from the retracted position state shown in FIG. 3 to another upper position state (for example, the position states of FIG. 10 to FIG. 14), the engagement state of the driving gear 82 axially supported by the output shaft 81 of the cam motor 80 with the driven gear 78 axially supported by the power transmission shaft 77, becomes released.

Next, the cam shape of each of the cam members 74 to 76 will be described.

As shown in FIG. 7A to 7C and FIG. 8, each of the cam members 74 to 76 is formed to have the same cam shape, respectively. Each of the cam members 74 to 76 is axially supported with an angle shifted in the rotational direction of the rotary shaft 73 for the other cam members with respect to the rotary shaft 73. In particular, on the basis of the angular position of the first cam member 74 for the rotary shaft 73, the second cam member 75 is angle-shifted by 45 degrees in the inverse rotational direction (the clockwise direction in FIGS. 7A to 7C) of the rotary shaft 73. On the other hand, the third cam member 76 is axially supported with an angle shifted by 45 degrees in the positive rotational direction (the counterclockwise direction in FIGS. 7A to 7C) of the rotary shaft 73.

Furthermore, in the peripheral plane of each of the cam members 74 to 76, arc-convexed cam functional portions 74*a*, 74*c*, 75*a*, 75*c*, 76*a* and 76*c*, which have relatively longer distance from the rotation center, and cam non-functional portions 74*b*, 74*d*, 75*b*, 75*d*, 76*b* and 76*d*, which have shorter distance from the rotation center than the cam functional portions, are formed in a series in an alternative arrangement in the circumferential direction. When the cam functional portion is located at the angular position of 0 degree in which it is just above the rotary shaft 73 (hereinafter, referred to as the "cam action position") in a case where each of the cam members 74 to 76 rotates with rotation of the rotary shaft 73, each of the cam members 74 to 76 cam-engages with the boost up force to the lower surface of corresponding movable plates 71*a* to 71*c*, whereby to boost upward movable plates 71*a* to 71*c*. On the other hand, in a case where the cam non-functional portion is located at the cam action position, each of the cam members 74 to 76 is configured to provide no boost up force to the movable plates 71*a* to 71*c*.

That is, in a case where the cam functional portion is located at the cam action position, each of the cam members 74 to 76 moves the maintenance device groups 72*a* to 72*c* to the upper abutting position that is a position state where the maintenance device 68 on the movable plates 71*a* to 71*c* boosted up with the cam functional portion comes into contact with corresponding recording heads 29, whereby to be capable of maintaining the recording head 29, when the elevating device 64 moves the maintenance cap 63 to the maintenance position as shown in FIG. 13. On the other hand, in a case where the cam non-functional portion is located at the cam action position, each of the cam members 74 to 76 moves the maintenance device groups 72*a* to 72*c* to the downward separating position (the position lower than the abutting position) where the maintenance device 68 on the movable plates 71*a* to 71*c* is in the position state as separated from the corresponding recording heads 29 when the elevating device 64 moves the maintenance cap 63 to the maintenance position.

First, the first cam member 74 shown in FIG. 7A is configured such that wide-angle first cam functional portion 74*a* is formed in the peripheral plane area that becomes located at the cam action position when the rotation angle becomes 90 degrees to 180 degrees in a case where the rotation angle of the rotary shaft 73 rotates from the state of the initial angle (0 degree) to a positive rotational direction (the counterclockwise direction in the same figure) as shown in the same figure. In addition, similarly, a narrow-angle second cam functional portion 74*c* is formed in the peripheral plane area that becomes located at the cam action position when the rotation angle of the rotary shaft 73 becomes 270 degrees. The wide-angle first cam non-functional portion 74*b* is formed in the peripheral plane area adjacent to the first cam functional portion 74*a* in the positive rotational direction of the rotary shaft 73, while the narrow-angle second cam non-functional portion 74*d* is formed in the peripheral plane area adjacent to the first cam functional portion 74*a* in the inverse rotational direction of the rotary shaft 73.

In addition, the second cam member 75 shown in FIG. 7B is configured such that the wide-angle first cam functional portion 75*a* is formed in the peripheral plane area that becomes located at the cam action position when the rotation angle becomes 135 degrees to 225 degrees in a case where the rotary shaft 73 rotates from the state of the initial angle (0 degree) to the positive rotational direction (the counterclockwise direction in the same figure) shown in the same figure. In addition, similarly, a narrow-angle second cam functional portion 75*c* is formed in the peripheral plane area that becomes located at the cam action position when the rotation angle of the rotary shaft 73 becomes 315 degrees. The wide-angle first cam non-functional portion 75*b* is formed in the peripheral plane area adjacent to the first cam functional portion 75*a* in the positive rotational direction of the rotary shaft 73, while the narrow-angle second cam non-functional portion 75*d* is formed in the peripheral plane area adjacent to the first cam functional portion 75*a* in the inverse rotational direction of the rotary shaft 73.

In addition, the third cam member 76 shown in FIG. 7C is configured such that the wide-angle first cam functional portion 76*a* is formed in the peripheral plane area that becomes located at the cam action position when the rotation angle becomes 45 degrees to 135 degrees in a case where the rotary shaft 73 rotates from the state of the initial angle (0 degree) to the positive rotational direction (the counterclockwise direction in the same figure) shown in the same figure. In addition, similarly, a narrow-angle second cam functional portion 76*c* is formed in the peripheral plane area that becomes located at the cam action position when the rotation angle of the rotary shaft 73 becomes 225 degrees. The wide-angle first cam non-functional portion 76*b* is formed in the peripheral plane area adjacent to the first cam functional portion 76*a* in the positive rotational direction of the rotary shaft 73, while the narrow-angle second cam non-functional portion 76*d* is formed in the peripheral plane area adjacent to the first cam functional portion 76*a* in the inverse rotational direction of the rotary shaft 73.

Therefore, if the cam motor 80 is driven in a case where the maintenance cap 63 is in the retracted position state shown in FIG. 3, and the driven gear 78 and the driving gear 82 are in the engagement, the driving force thereof is transmitted to the rotary shaft 73 through the power transmission shaft 77. As a result, each of the cam members 74 to 76 rotates integrally together with the rotary shaft 73. In the cam members 74 to 76, the peripheral plane area of any one of the first cam functional portions 74*a*, 75*a* and 76*a*, the first cam non-functional portions 74*b*, 75*b* and 76*b*, the second cam functional portions 74*c*, 75*c* and 76*c*, and the second cam non-functional portions 74*d*, 75*d* and 76*d*, is located at the angular position of 0 degree in which it is just above the rotary shaft 73 (i.e., the cam action position) depending on the rotation angle of the rotary shaft 73. In addition, the rotation angles of the rotary shaft 73 and each of the cam members 74 to 76 in this case are measured by an angle sensor 95 (see FIG. 9), which is composed of a rotary potentiometer arranged in a position close to the rotary shaft 73 and the like.

Incidentally, if the state shown in FIG. 3, FIGS. 7A to 7C and FIG. 8 (the state where the rotation angle of the rotary shaft 73 is the initial angle (0 degree)) is assumed as the first state of angle, at this first state of angle, each of the first cam non-functional portions 74*b*, 75*b* and 76*b* is located at the cam action position in each of the cam members 74 to 76. That is, the cam functional portions 74*a*, 74*c*, 75*a*, 75*c*, 76*a* or 76*c* that can provide the boost up force to the movable plates 71*a* to 71*c*, is not located at the cam action position in any of the cam members 74 to 76 at this first state of angle. Therefore, all of the maintenance device groups 72*a* to 72*c* supported by each of the movable plates 71*a* to 71*c* become located at the downward separating position among the upper and the downward two positions at this first state of angle.

Next, at the second state of angle where the rotary shaft 73 is rotated by 45 degrees in the positive rotational direction from the first state of angle, the first cam non-functional portion 74*b* in the first cam member 74, the first cam non-functional portion 75*b* in the second cam member 75, and the first cam functional portion 76*a* in the third cam member 76 are located respectively at the cam action position. Therefore, at the second state of angle, only the third movable plate 71*c* is upward boosted, which corresponds to the third cam member 76 that locates the first cam functional portion 76*a* at the cam action position. Therefore, at the second state of angle, only the third maintenance device group 72*c* supported by the third movable plate 71*c* is located at the upper abutting position, while the first maintenance device groups 72*a* and the second maintenance device group 72*b* supported by the first movable plate 71*a* and the second movable plate 71*b* are located at the downward separating position.

Next, at the third state of angle where the rotary shaft 73 is rotated by 45 degrees in the positive rotational direction from the second state of angle, the first cam functional portion 74*a* in the first cam member 74, the first cam non-functional portion 75*b* in the second cam member 75, and the first cam functional portion 76*a* in the third cam member 76 are located respectively at the cam action position. Therefore, at the third state of angle, the first movable plate 71*a* and the third movable plate 71*c* are upward boosted, which correspond to the first cam member 74 and the third cam member 76 that locate the first cam functional portions 74*a* and 76*a* at the cam action position. Therefore, at the third state of angle, the first maintenance device groups 72*a* and the third maintenance device group 72*c* supported by the first movable plate 71*a* and the third movable plate 71*c* are located at the upper abutting position, while the second maintenance device group 72*b* supported by the second movable plate 71*b* is located at the downward separating position.

Next, at the fourth state of angle where the rotary shaft 73 is rotated by 45 degrees in the positive rotational direction from the third state of angle, the first cam functional portions 74*a*, 75*a* and 76*a* of all of the cam members 74 to 76 are located at the cam action position. Therefore, at the fourth state of angle, all of the cam members 74 to 76 boost upward each of the corresponding movable plates 71*a* to 71*c*. Therefore, at the third state of angle, all of the maintenance device groups 72*a* to 72*c* supported by each of the movable plates 71*a* to 71*c* are located at the upper abutting position.

Next, at the fifth state of angle where the rotary shaft 73 is rotated by 45 degrees in the positive rotational direction from the fourth state of angle, the first cam functional portion 74*a* in the first cam member 74, the first cam functional portion 75*a* in the second cam member 75, and the second cam non-functional portion 76*d* in the third cam member 76 are located respectively at the cam action position. Therefore, at the fifth state of angle, the first movable plate 71*a* and the second movable plate 71*b* are upward boosted, which correspond to the first cam member 74 and the second cam member 75 that locate the first cam functional portions 74*a* and 75*a* at the cam action position. Therefore, at the fifth state of angle, the first maintenance device groups 72*a* and the second maintenance device group 72*b* supported by the first movable plate 71*a* and the second movable plate 71*b* are located at the upper abutting position, while the third maintenance device group 72*c* supported by the third movable plate 71*c* is located at the downward separating position.

Next, at the sixth state of angle where the rotary shaft 73 is rotated by 45 degrees in the positive rotational direction from the fifth state of angle, the second cam non-functional portion 74*d* in the first cam member 74, the first cam functional portion 75*a* in the second cam member 75 and the second cam functional portion 76*c* in the third cam member 76 are located respectively at the cam action position. Therefore, at the sixth state of angle, the second movable plate 71*b* and the third movable plate 71*c* are upward boosted up, which correspond to the second cam member 75 and the third cam member 76 that locate the first cam functional portion 75*a* and the second cam functional portion 76*c* at the cam action position. Therefore, at the sixth state of angle, the second maintenance device group 72*b* and the third maintenance device group 72*c* supported by the second movable plate 71*b* and the third movable plate 71*c* are located at the upper abutting position, while the first maintenance device groups 72*a* supported by the first movable plate 71*a* is located at the downward separating position.

Next, at the seventh state of angle where the rotary shaft 73 is rotated by 45 degrees in the positive rotational direction from the sixth state of angle, the second cam functional portion 74*c* in the first cam member 74, the second cam non-functional portion 75*d* in the second cam member 75, and the first cam non-functional portion 76*b* in the third cam member 76 are located respectively at the cam action position. Therefore, at the seventh state of angle, only the first movable plate 71*a* is upward boosted, which corresponds to the first cam member 74 wherein the second cam functional portion 74*c* is located at the cam action position. Therefore, at the seventh state of angle, the first maintenance device groups 72*a* supported by the first movable plate 71*a* is located at the upper abutting position, while the second maintenance device group 72*b* and the third maintenance device group 72*c* supported by the second movable plate 71*b* and the third movable plate 71*c* are located at the downward separating position.

Next, at the eighth state of angle where the rotary shaft 73 is rotated in the positive rotational direction by 45 degrees from the seventh state of angle, the first cam non-functional portion 74*b* in the first cam member 74, the second cam functional portion 75*c* in the second cam member 75, and the first cam non-functional portion 76*b* in the third cam member 76 are located respectively at the cam action position. Therefore, at the eighth state of angle, only the second movable plate 71*b* is upward boosted, which corresponds to the second cam member 75 that locates the second cam functional portion 75*c* at the cam action position. Therefore, at the eighth state of angle, the second maintenance device group 72*b* supported by the second movable plate 71*b* is located at the upper abutting position, while the first maintenance device groups 72*a* and the third maintenance device group 72*c* supported by the first movable plate 71*a* and the third movable plate 71*c* are located at the downward separating position. If the rotary shaft 73 is further rotated by 45 degrees in the positive rotational direction from this eighth state of angle, it becomes the above-mentioned first state of angle.

Next, the electrical configuration of the above-mentioned printer 11 will be described below on the basis of FIG. 9.

As shown in FIG. 9, the control section 91 in this printer 11 includes CPU 92 that functions as a central processing unit. The CPU 92 is connected with ROM 93 and RAM 94. In the ROM 93, various types of control programs are memorized for controlling the operation state of the printer 11. In addition, in the RAM 94, various types of information are recorded, which is properly rewritten by the CPU 92 in the driving of the printer 11.

The elevating sensor 65 and the angle sensor 95 are connected in the input side of the control section 91, while each of the drive circuits of the pressurizing pump 38, the movement motor 57, the elevating device 64, the cam motor 80, the atmosphere opening valve 90 and the suction pump 96 is connected to the output side of the control section 91. The control section 91 controls each of the driving status of the pressurizing pump 38, the movement motor 57, the elevating device 64, the cam motor 80, the atmosphere opening valve 90 and the suction pump 96 on the basis of the detection signal input from the elevating sensor 65 and the angle sensor 95.

Next, the action of the printer 11 of the embodiment, specifically the maintenance action by the maintenance mechanism 30 will be described below.

First, at the time when the power supply of the printer 11 is turned off, the carriage 27 moves to the non-printing region, and stops at the position where the recording head 29 is at the home position (the position in FIG. 3 and FIG. 10 to FIG. 14). In a case where the moisturizing cap 53 is at the non-interference position shown with a double-dashed line in FIG. 3 at the time point, the first cap device moving process is executed, and the movement motor 57 is driving-controlled in a direction to rotate the pinion 56 in the counterclockwise direction in FIG. 3.

Then, the belt-like plate 52 that engages the racks 55 with the pinion 56 moves to the interference position shown with the solid line in FIG. 3 from non-interference position. Therefore, the moisturizing cap 53 supported by the belt-like plate 52 as installed, also moves to the interference position from the non-interference position. In addition, in a case where the moisturizing cap 53 is already located at the interference position at the time point of the power supply off, the movement motor 57 is not driven.

Figure 10:
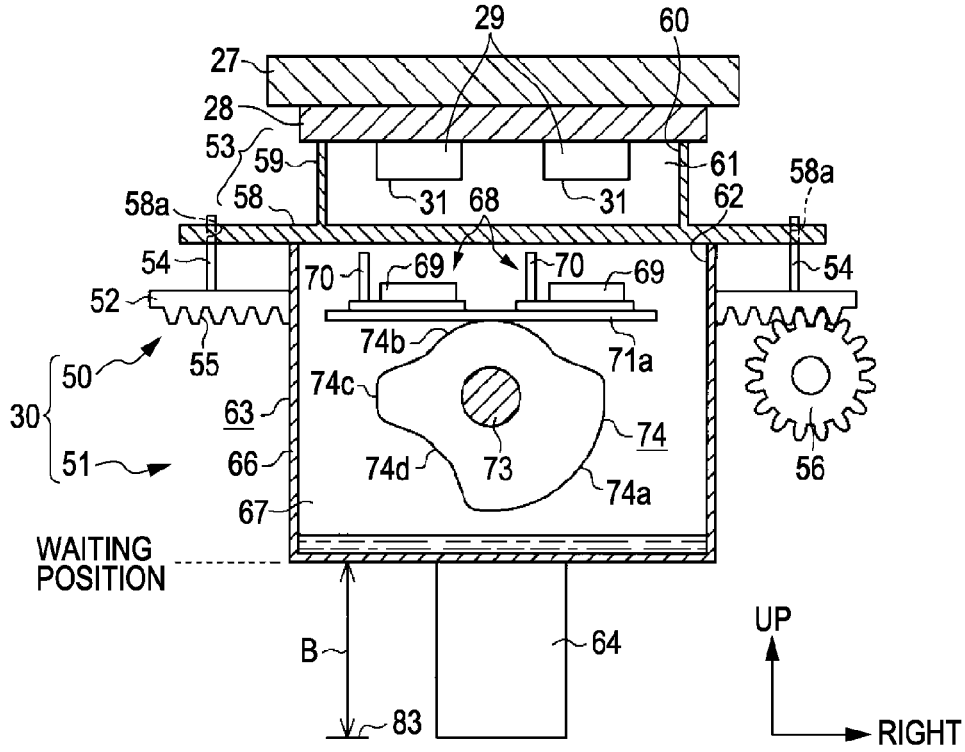
FIG. 10 is an operational explanatory diagram of the maintenance mechanism when a power supply of the printer is turned off.

Then, by the driving of the elevating device 64, the maintenance cap 63 moves up to the waiting position where the bottom surface is upward located by the distance B (distance B>distance A) from the reference plane 83 as shown in FIG. 10. In addition, as a premise therefor, in a case where the state of angle of the rotary shaft 73 that axially supports the cam members 74 to 76 to be rotatable integrally, is not the first state of angle, the cam motor 80 is driving-controlled by the control section 91 in the maintenance unit 51 to rotate the rotary shaft 73 so as to change the state of angle to the first state of angle.

That is, in this case, the maintenance cap 63 moves down to the retracted position shown in FIG. 3 by the driving of the elevating device 64. Then, at a state where the driven gear 78 axially supported by the power transmission shaft 77 and the driving gear 82 axially supported by the output shaft 81 of the cam motor 80 are in the engagement, the control section 91 driving-controls the cam motor 80 so as to have the rotary shaft 73 in the first state of angle on the basis of the detection signal of the angle sensor 95.

Then, the driving force of the cam motor 80 is power-transmitted from the driving gear 82 to the driven gear 78, and further transferred from the power transmission shaft 77 to the rotary shaft 73 through the worm 79 and the worm wheel. If the rotary shaft 73 is in the first state of angle, the first cam non-functional portions 74*b*, 75*b* and 76*b* in each of the cam members 74 to 76 are located at the cam action position. Therefore, each of the movable plates 71*a* to 71*c* that supports the maintenance device groups 72*a* to 72*c* in the maintenance cap 63, is supported at the low position where it comes into contact with the cam non-functional portion which has shorter distance from the rotation center than the cam functional portion in the peripheral plane of each of the cam members 74 to 76. As a result, all of the maintenance device groups 72*a* to 72*c* in the state of being supported on each of the movable plates 71*a* to 71*c* in the maintenance cap 63 are at the downward separating position among the two positions of the upper and the downward positions, and each maintenance device 68 is in a position state where each of the upper ends (for example, the upper end of the wiper member 70) is not projected upward from the opening 62 of the maintenance cap 63.

Figure 11:
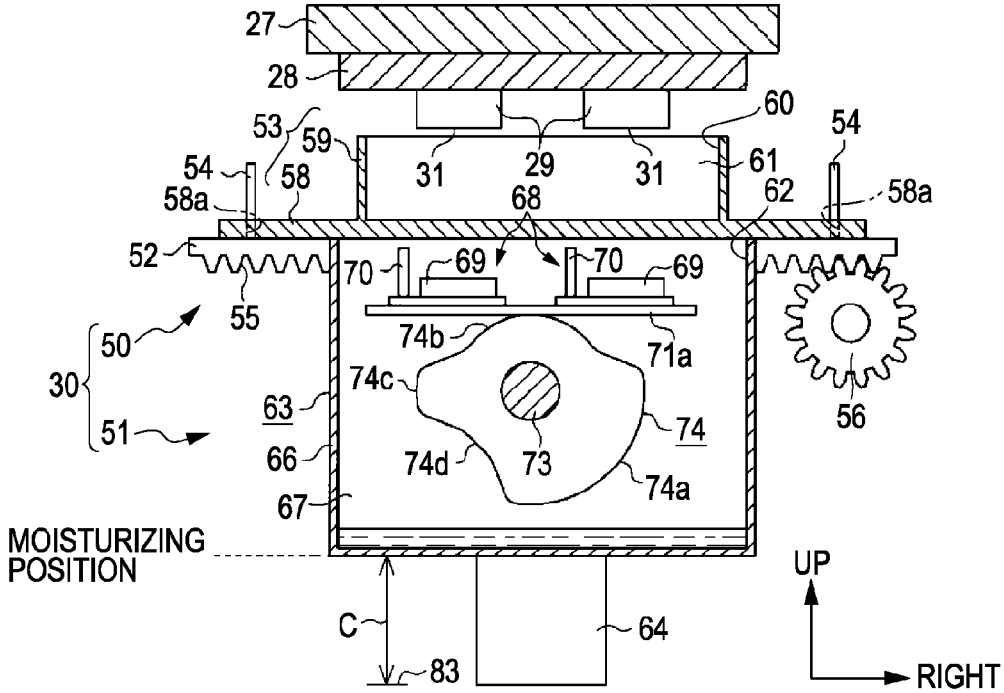
FIG. 11 is an operational explanatory diagram of the maintenance mechanism when the printer performs printing.

In this state, the maintenance cap 63 moves up by the driving of the elevating device 64 from the retracted position of FIG. 3 to the maintenance device moisturizing position (hereinafter, briefly called "the moisturizing position". In addition, it is briefly shown as "the moisturizing position" in FIG. 11) where the bottom surface is upward located by distance C (distance B>distance C>distance A) from the reference plane 83 as shown in FIG. 11. Then, with the maintenance cap 63 moving up, the upper end of the peripheral wall portion 66 comes into contact with the lower surface of the substrate portion 58 of the moisturizing cap 53 located at the interference position, and the opening 62 is covered by the moisturizing cap 53 that is another member. In addition, in this case, if the maintenance cap 63 moves upward from the retracted position, the engagement relationship of the driven gear 78 and the driving gear 82 is released, and thus there is a fear that the rotary shaft 73 in the first state of angle is in the idle rotation. However, in the embodiment, the engagement of the worm 79 of the power transmission shaft 77 with the worm wheel of the rotary shaft 73 suppresses the idle rotation.

If the maintenance cap 63 further moves up upward from the moisturizing position shown in FIG. 11 by the driving of the elevating device 64, the moisturizing cap 53 is boosted up toward the upper side of the recording head 29 by the ascending maintenance cap 63 in the second cap device moving process. In addition, at this time, the moisturizing cap 53 moves up and down as guided by the guide rod 54 in a state where the guide rod 54, which is disposed upright from the belt-like plate 52, is inserted through to the guide hole 58*a* formed in the four corners of the substrate portion 58. Therefore, the moisturizing cap 53 ascends in a state where the position shift is suppressed in the horizontal direction.

If the maintenance cap 63 ascends to the waiting position shown in FIG. 10 by the driving of the elevating device 64, the peripheral wall portion 59 of the moisturizing cap 53 that is in the lamination state on the maintenance cap 63 comes into contact with the lower surface of the support plate 28 that supports the recording head 29 to be in a state of surrounding all of the recording head 29, and the opening 60 is covered by the support plate 28 that is another member. As a result, the moisturizing cap 53 is in a state where the internal spatial region 61 is kept airtight, and in a state where the recording head 29 is enclosed in the spatial region 61. Therefore, since the recording head 29 is in the airtight atmosphere blocked from the atmosphere, suppressed are increase in the ink viscosity by evaporation of the ink solvent from the nozzles 32 during the period of time of power supply off, and contamination of the air bubbles from the nozzles 32, and the like.

On the other hand, in the waiting position shown in FIG. 10, the maintenance cap 63 is in the open valve state where the atmosphere opening valve 90 of the atmosphere opening hole 89 is open before the power supply off. The pressurizing pump 38 is driven by the control of the control section 91, and thereby the moisturizing liquid is supplied to the spatial region 67 in the maintenance cap 63 through the moisturizing liquid supply tube 37 from the moisturizing liquid cartridge 35. At this time, the moisturizing liquid which is pressure-supplied to the spatial region 67 in the maintenance cap 63 with pressure application of the pressurizing pump 38 is discharged to the outside of the maintenance cap 63 from the discharge port 87 of the moisturizing liquid discharge channel 86, if the height of the liquid level 88 in the spatial region 67 is greater than that of the threshold liquid level.

If the supply of the moisturizing liquid to the spatial region 67 in the maintenance cap 63 is once completed, the atmosphere opening valve 90 is switched to the closed valve state by the control of the control section 91. Then, the spatial region 67 in the maintenance cap 63 receiving the maintenance device 68 and the like becomes the spatial region 67 in which the moisturizing atmosphere is kept airtight by the moisturizing liquid retained on the internal bottom surface. Therefore, through such a moisturizing atmosphere, the maintenance device 68 and the rotary shaft 73 which have the cap member 69 and the wiper member 70 as main constituents, and the displacement member which has each of the cam members 74 to 76 as main constituents, maintain the moisturizing state mechanically. As a result, drying and solidification of the ink attached on the surface of the maintenance device 68 also disappears. At this time, the cap member 69 and the wiper member 70 preferably do not come into contact with other members. By this, adhesion at the contact part with other members can be prevented. In addition, the inside of the cap member 69 can be held in the moisturizing state.

Then, in a case where the power supply of the printer 11 is in the on state, and printing is executed for the continuous sheet 13, the maintenance cap 63 moves down from the waiting position of FIG. 10 to the moisturizing position shown in FIG. 11 by the driving of the elevating device 64. Then, the moisturizing cap 53 also moves down along with the maintenance cap 63, and the recording head 29 which has been located in the moisturizing cap 53 so far, becomes located in the upper idle area rather than the opening 60 of the moisturizing cap 53. As a result, the carriage 27 mounted with the recording head 29 is movable from the non-printing region to the printing region. By ejecting ink from the recording head 29 in the printing region, printing for the continuous sheet 13 is executed.

Meanwhile, during the execution of such printing, discharge of the ink as wasted ink, i.e., so-called flushing may be performed on the basis of the control signal having no relationship with the printing from the nozzles 32 of the recording head 29. This flushing includes the weak flushing wherein a small amount of wasted ink is discharged per performance of the printing of predetermined pages, and the strong flushing wherein a greater amount of wasted ink than the weak flushing is discharged per elapse of a constant period of time. In a case of the weak flushing, the carriage 27 mounted with the recording head 29 moves to the upper position of a flushing box (not shown) provided in both of the front and the back of the platen 19, and the wasted ink is discharged from the recording head 29 to the inside of the flushing box.

On the other hand, in a case of the strong flushing, the wasted ink is discharged from the recording head 29 to the inside of the cap member 69 included by the maintenance device 68 of the maintenance unit 51. Therefore, in a case of performing this strong flushing, the moisturizing unit 50 moves from the interference position to the non-interference position in the right side of the horizontal direction, and this becomes a position state where the moisturizing unit 50 is separated in the horizontal direction from the path of the up and down movement of the maintenance cap 63 in the maintenance unit 51.

Figure 12:
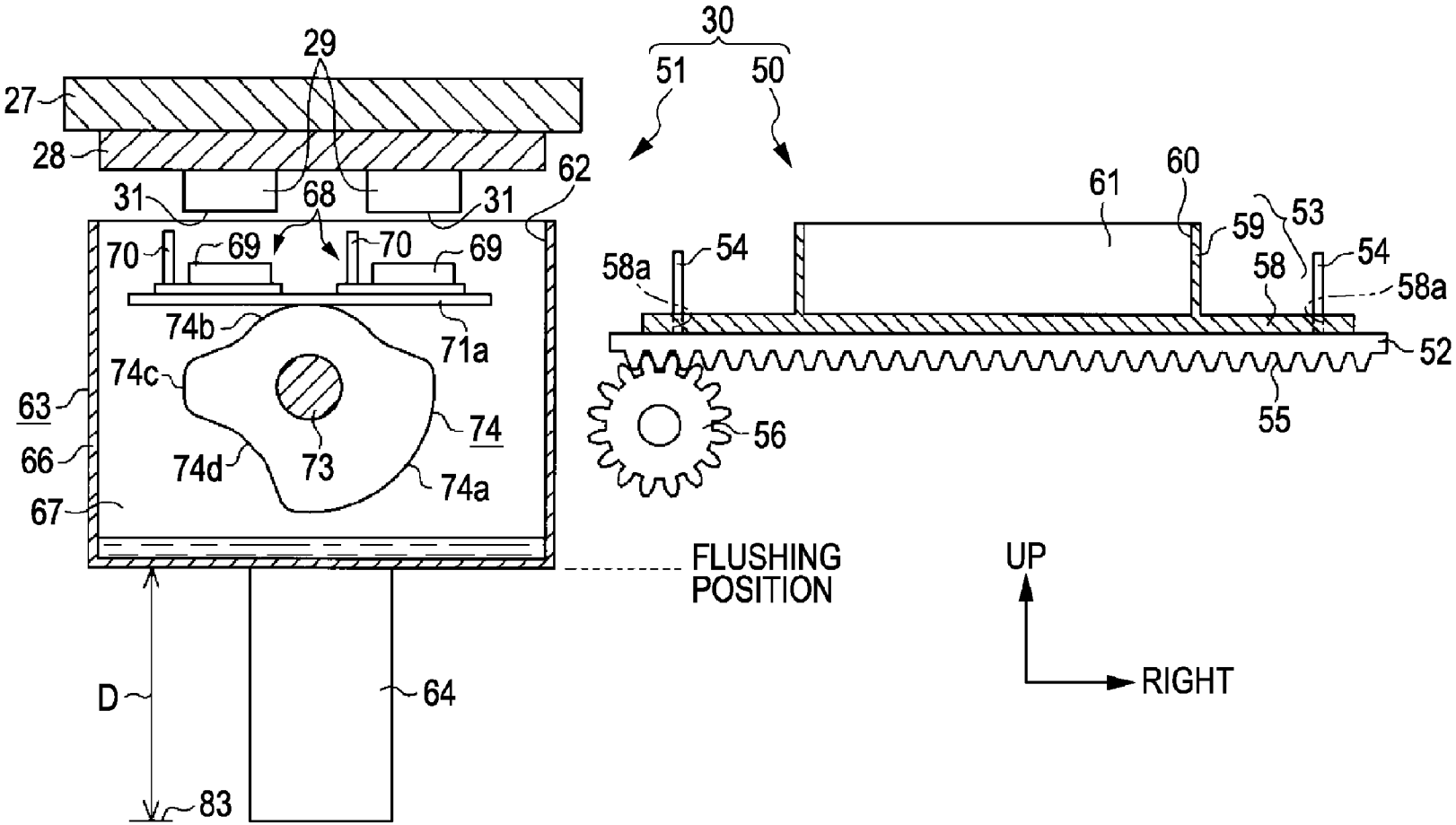
FIG. 12 is an operational explanatory diagram of the maintenance mechanism when the printer performs flushing.

That is, the maintenance cap 63 moves down slightly by the driving of the elevating device 64, and the contact state with the substrate portion 58 is released. The movement motor 57 is driving-controlled by the control section 91 to rotate the pinion 56 in the clockwise direction in FIG. 11. The belt-like plate 52 that engages the racks 55 with the pinion 56 moves horizontally from the interference position of FIG. 11 to the non-interference position as shown in FIG. 12. As a result, the moisturizing cap 53 supported on this belt-like plate 52 as installed also moves horizontally along with the belt-like plate 52 from the interference position to the non-interference position.

Then, the maintenance cap 63 moves up by the driving of the elevating device 64 from the moisturizing position of FIG. 11 to the flushing position where the bottom surface as shown in FIG. 12 is located upward from the reference plane 83 by the distance D (distance D>distance B). Then, the upper end of the peripheral wall portion 66 in the maintenance cap 63 is located just below the nozzle forming surface 31 of the recording head 29, and thereby each maintenance device 68 of the cap member 69 is located just below the nozzle forming surface 31 of individual corresponding recording head 29 with small interval. In this state, wasted ink is discharged from the nozzles 32 of the recording head 29 to the inside of the cap member 69 just below.

In addition, also in this case, the rotation angle of the rotary shaft 73 axially supporting each of the cam members 74 to 76 to be rotatable integrally is maintained at the first state of angle by engagement of the worm 79 of the power transmission shaft 77 with the worm wheel of the rotary shaft 73. If such flushing is completed, the carriage 27 mounted with the recording head 29 moves again from the non-printing region to the printing region, and ink is again ejected for printing of the continuous sheet 13 from the recording head 29 in the printing region.

Next, in a case where cleaning is performed, in which ink is forcibly discharged from the nozzles 32 of each recording head 29, first, the moisturizing unit 50 moves to the non-interference position similarly to the case of performing the above-mentioned strong flushing. In the maintenance unit 51, the maintenance cap 63 move downs to the retracted position shown in FIG. 3 by the driving of the elevating device 64, and the driven gear 78 axially supported by the power transmission shaft 77, and the driving gear 82 axially supported by the output shaft 81 of the cam motor 80, are engaged. The control section 91 driving-controls the cam motor 80 on the basis of the recording head 29 wanted to be performed for cleaning and the detection signal of the angle sensor 95 at the time point.

For example, in a case of executing cleaning in all of the recording heads 29, the rotational direction and the rotation amount of the cam motor 80 are controlled such that all of the first to third cam members 74 to 76 are in the fourth state of angle (in this case, 135 degrees), which is the rotation angle in which the first cam functional portions 74*a*, 75*a* and 76*a*, can be located at the cam action position. In addition, in a case of selectively cleaning five recording heads 29 in the zigzag-like arrangement in the back side corresponding individually to the first maintenance device groups 72*a* supported by the first movable plate 71*a*, the cam motor 80 is driving-controlled to be in the seventh state of angle in which only the first cam member 74 corresponding to the first movable plate 71*a* locates the second cam functional portion 74*c* at the cam action position.

That is, by controlling the rotation angle of the rotary shaft 73 to be switched with 45 degree clearance in multiple steps from the first state of angle to the eighth state of angle, the cap member 69 corresponding individually to each recording head 29 is moved up and down individually (individual moving process) on the basis of the displacement operation of the displacement members composed of the cam member 74 and the rotary shaft 73. By such individual control of up and down movement, selective cleaning of the recording head 29 by the maintenance device 68 becomes possible.

The maintenance device groups 72*a* to 72*c* supported on the movable plates 71*a* to 71*c* corresponding to the cam members 74 to 76 in which the cam functional portion is located at the cam action position with the rotation of the rotary shaft 73, ascend along with the movable plates 71*a* to 71*c*, for example, from the lower separating position shown in FIG. 12 to the upper abutting position shown in FIG. 13. In addition, the up-and-down stroke in this case is the difference of the distances from the rotation center between the cam functional portion and the cam non-functional portion formed in the peripheral plane of the cam members 74 to 76. The up-and-down stroke has small stroke length in terms of the distance, and thus the fear of the error occurrence is small at the time of up and down movement between each of the first to third the movable plates 71*a* to 71*c*.

Next, the maintenance cap 63 moves up by the driving of the elevating device 64 from the lowest retracted position to the uppermost maintenance position in which the bottom surface is located upward from the reference plane 83 by the distance E (distance E>distance D) as shown in FIG. 13. Then, in the maintenance unit 51, the cap member 69 of the maintenance device 68 on the movable plates 71*a* to 71*c* that are boosted upward by the cam members 74 to 76 in which the cam functional portion is located at the cam action position, comes into contact with the nozzle forming surface 31 of the corresponding recording head 29 so as to surround all the nozzle rows 33 formed on the nozzle forming surface 31.

In addition, differently from the individual up and down with small up-and-down stroke depending on the difference of the distances from the rotation center between the cam functional portion and the cam non-functional portion of the cam members 74 to 76, in this case, all of the maintenance device 68 is simultaneously moved up and down (simultaneous moving process) along with the maintenance cap 63 received in the internal spatial region 67 with the up-and-down stroke corresponding to the height difference of the maintenance position and the retracted position (distance E−distance A). At this time, the driving source for simultaneous moving up and down is a single elevating device 64 only. If the suction pump 96 is driving-controlled by the control section 91 in the state shown in FIG. 13, the inside of the cap member 69 that is in contact with the nozzle forming surface 31 of the recording head 29 comes to have a negative pressure, and the wasted ink is forcibly sucked and discharged from the nozzles 32 of the recording head 29.

Figure 14:
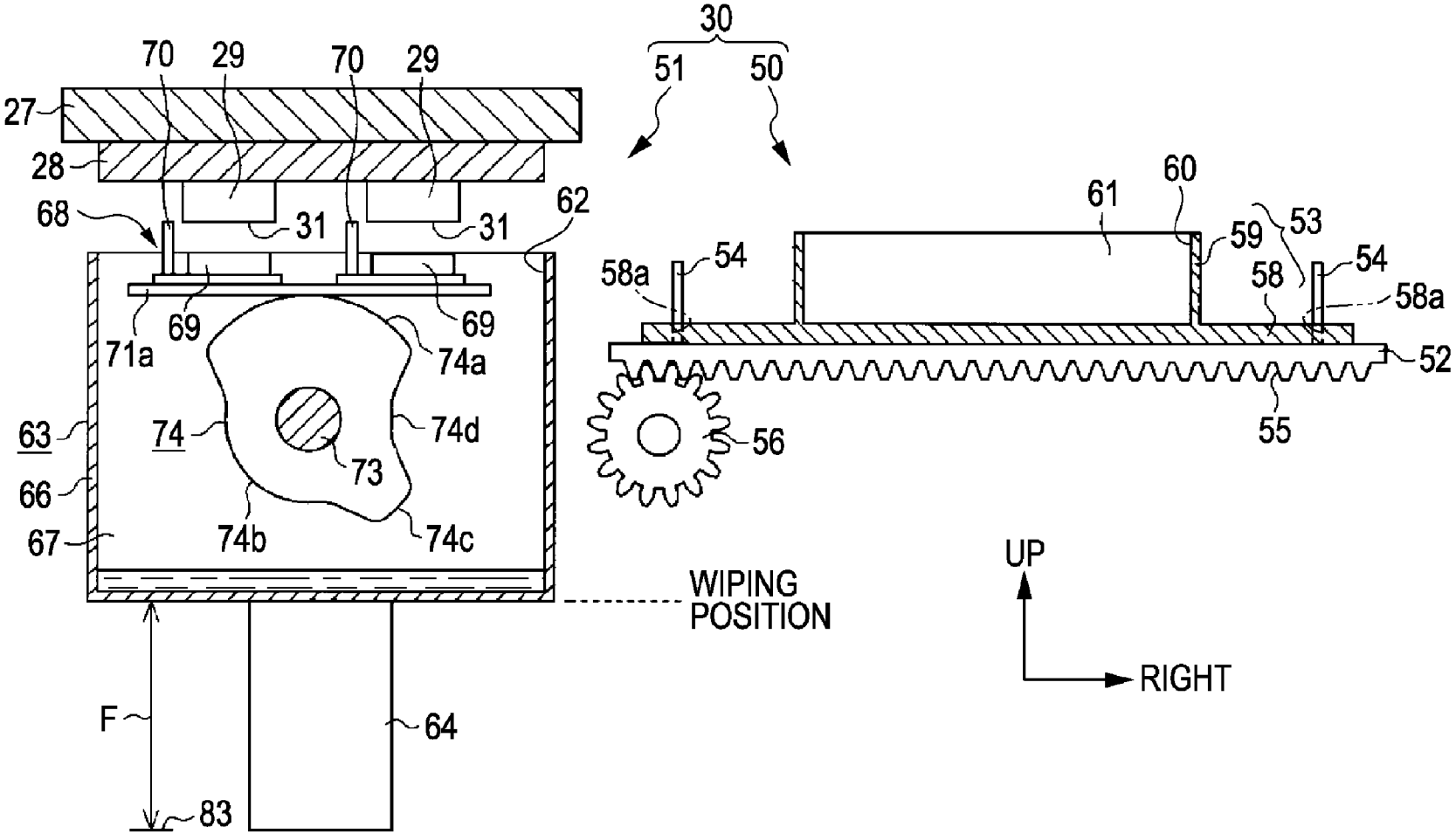
FIG. 14 is an operational explanatory diagram of the maintenance mechanism when the printer performs wiping.

Next, at the wiping time of wiping out the nozzle forming surface 31 of the recording head 29 for which such cleaning has been completed, the maintenance cap 63 moves down by the driving of the elevating device 64 to the wiping position in which the bottom surface is upward located from the reference plane 83 by distance F (distance E>distance F≈distance D) as shown in FIG. 14. In this state, if the carriage 27 mounted with the recording head 29 moves to the horizontal direction (the left direction in the case of FIG. 14), the wiper member 70 of each maintenance device 68 is in sliding contact with the nozzle forming surface 31 of the recording head 29, with the upper end side curved. By the action of the sliding contact, the ink is wiped out from the nozzle forming surface 31 of the recording head 29.

According to the above-mentioned embodiment, effects described below can be obtained.

(1) A plurality of maintenance devices 68 which corresponds to the recording head 29 is supported by the maintenance cap 63. The elevating device 64 moves all of the maintenance devices 68 simultaneously to the maintenance position by moving the maintenance cap 63. Therefore, the error of the up and down (movement) stroke in each maintenance device 68 can be reduced as compared with the case where each maintenance device 68 is moved individually from the retracted position to the maintenance position. Furthermore, each of the cam members 74 to 76 which constitute the individual transfer mechanism moves a plurality of maintenance device groups 72*a* to 72*c* including at least one of the maintenance devices 68 in the approaching and separating directions for the respective recording heads 29. Therefore, by rotating the cam members 74 to 76, selective maintenance of the recording head 29 becomes possible by the maintenance device groups 72*a* to 72*c* moving up to the abutting position that approaches the recording head 29. Therefore, selective cleaning of the recording head 29 can be positively executed with an attempt to simplify the configuration.

(2) The cam members 74 to 76 move the maintenance device groups 72*a* to 72*c* in a state where the maintenance cap 63 is located at the retracted position. That is, since the maintenance device groups 72*a* to 72*c* located at the retracted position are separated from the recording head 29, movement of the maintenance device groups 72*a* to 72*c* by the cam members 74 to 76 can be performed without contact with the recording head 29. Therefore, since the maintenance device groups 72*a* to 72*c* have no contact with the recording head 29 even when they have moved in the retracted position, the power transmission mechanism composed of the cam members 74 to 76 and the cam motor 80 can be improved in durability.

(3) Since the cam motor 80 is set up in a separate position from that of the maintenance cap 63, the position state of the cam motor 80 is preserved though the maintenance cap 63 and the maintenance device 68 are moved by the elevating device 64. That is, by trimming the weight of the mechanism moved by the elevating device 64, the driving load of the elevating device 64 can be reduced.

(4) Since the maintenance device groups 72*a* to 72*c* are moved with rotation of the cam members 74 to 76, the response for the switching of the position of the maintenance device groups 72*a* to 72*c* can be improved. Furthermore, by providing the driving gear 82 and the driven gear 78, switching of the power transmission can be performed with the simple configuration by the engagement between the gears and the release of the engagement.

(5) The maintenance device groups 72*a* to 72*c*, which is moved to the maintenance position by the elevating device 64, and moved to the abutting position by the cam members 74 to 76, can bring the maintenance device 68 contained in the maintenance device groups 72*a* to 72*c* into contact with the corresponding recording head 29, and to thereby perform the maintenance smoothly.

(6) In a case where the elevating device 64 moves the maintenance cap 63 to the flushing position, the cap member 69 can take the ink in a position nearer to the recording head 29 than to the retracted position. Therefore, flying of the ink ejected with flushing can be suppressed, and thereby contamination of the printer 11 can be suppressed.

(7) Since the elevating device 64 moves simultaneously the maintenance device 68 including the wiper member 70 along with the maintenance cap 63 up to the wiping position, it is possible to reduce the stroke error compared to the case of individually moving the wiper member 70.

(8) By applying the pressure to both of the ink cartridge 34 and the moisturizing liquid cartridge 35 by the pressurizing pump 38, ink and the moisturizing liquid can be supplied that are received in each of them. That is, there is included the pressurizing pump 38 that leads out the moisturizing liquid from the moisturizing liquid cartridge 35 to the spatial regions 61 and 67 of the moisturizing cap 53 and the maintenance cap 63, so that alignment of the moisturizing liquid cartridge 35, the moisturizing cap 53 and the maintenance cap 63 becomes unnecessary, and thereby it becomes possible to supply the moisturizing liquid regardless of the position relationship thereof. Therefore, for example, it is possible to supply the moisturizing liquid while maintaining the state where the moisturizing cap 53 covers the nozzle forming surface 31. The pressurizing pump 38 that leads out the ink within the ink cartridge 34 toward the recording head 29 also includes a mechanism to lead out the moisturizing liquid. Therefore, the mechanism to lead out the moisturizing liquid does not need to be included individually, thereby allowing the configuration to be miniaturized and simplified.

(9) The moisturizing liquid, which is supplied to the inside of the spatial regions 61 and 67 of the moisturizing cap 53 and the maintenance cap 63, flows out to the outside of the maintenance cap 63 from the discharge port 87 in a case where the liquid level 88 becomes equal to or greater than the height of the threshold liquid level. Therefore, it is possible to make a constant amount of the moisturizing liquid remain within the maintenance cap 63 with the simple configuration. Furthermore, it is possible to suppress the overflow of the moisturizing liquid from the opening 60 of the maintenance cap 63. That is, it is possible to easily recover the moisturizing liquid by forming the outflow path of the extra moisturizing liquid, and suppress contamination in the printer 11.

(10) The moisturizing liquid, which is supplied through the moisturizing liquid supply tube 37 and the moisturizing liquid flow channel 84 constituting the moisturizing liquid supply channel, is discharged from the discharge port 87 through the moisturizing liquid discharge channel 86 if the height of the liquid level 88 of the moisturizing liquid, which is supplied to the inside of the spatial region 67 of the maintenance cap 63, is equal to or greater than the height position that corresponds to the discharge port 87. Therefore, it is possible to suppress the overflow of the moisturizing liquid from the maintenance cap 63, and make a constant the amount of the moisturizing liquid remain within the maintenance cap 63. In addition, for the spatial region 67 of the maintenance cap 63, it is possible to enhance the moisturizing efficiency in the enclosed space blocked from the atmosphere by the moisturizing liquid supplied and retained in the inside.

(11) The maintenance device 68 is received in the spatial region 67 in the maintenance cap 63 supplied by the moisturizing liquid, and kept airtight by covering the opening 62 of the spatial region 67 with the moisturizing cap 53. Therefore, it is possible for the maintenance device 68 received in the enclosed space to moisturize the cap member 69 and the wiper member 70 that constitute this device. Therefore, it is possible to suppress drying of the ink attached to the cap member 69 and the wiper member 70, and suppress contamination of the recording head 29, which is involved with the attachment of the dried and thickened ink to the recording head 29.

(12) The moisturizing cap 53 can moisturize the recording head 29 by the opening 60 being covered by the recording head 29 or the support plate 28 supporting the recording head 29 in a disposition state where the opening surrounds the nozzles 32 of the nozzle forming surface 31. In addition, since the opening 62 of the maintenance cap 63 is covered by the moisturizing cap 53, it is possible to moisturize the cap member 69 and the wiper member 70 that are received in the spatial region 67 of the maintenance cap 63. In a case where the moisturizing cap 53 and the maintenance cap 63 are provided, it becomes possible to make the inside of the maintenance cap 63 be airtight without separately providing other members covering the opening 62 by covering the opening 62 of the maintenance cap 63 by another moisturizing cap 53, resulting in simplification of the configuration of the printer 11.

(13) The spatial region 67 of the maintenance cap 63 is in the open valve state of the atmosphere opening valve 90 at the supply time of the moisturizing liquid even though it is kept airtight by the opening 62 being covered by other members. For this reason, the gas in the maintenance cap 63, which has pressure raised by supply of the moisturizing liquid, is discharged through the atmosphere opening hole 89. Therefore, it is possible to suppress the increase of the internal pressure and thereby to easily supply the moisturizing liquid. Furthermore, since the atmosphere opening valve 90 is in the closed valve state at the no supply time of the moisturizing liquid, it is possible to suppress evaporation of the moisturizing liquid to the outside of the maintenance cap 63 through the atmosphere opening hole 89.

(14) The moisturizing cap 53 can suppress drying of the ink in the nozzles 32 by surrounding the nozzles 32 by the spatial region 61 that is kept airtight. In addition, since the opening 62 of the maintenance cap 63 is covered by the moisturizing cap 53, it is possible to suppress drying of the cap member 69 and the wiper member 70 received in the spatial region 67 of the maintenance cap 63. Therefore, it is possible to suppress the contamination of the recording head 29, which is involved with the attachment of the dried and thickened ink. Furthermore, the moisturizing cap 53 located at the interference position approaches the recording head 29 to be pushed by the maintenance cap 63 moving on the basis of the driving force of the elevating device 64. Therefore, the belt-like plate 52 and the pinion 56 may be configured to move the moisturizing cap 53 in the front-back direction intersecting the movement direction of the elevating device 64. That is, it is possible to move the moisturizing cap 53 in two directions, i.e., the movement direction of the interference position and the non-interference position (the front-back direction), and the movement direction by the elevating device 64 (the horizontal direction), with the simple configuration.

(15) The moisturizing cap 53 located at the interference position is guided by the guide rod 54 when it approaches the recording head 29 with the moving of the maintenance cap 63. Therefore, it is possible to suppress the shift between the moisturizing cap 53 and the recording head 29 and thereby to improve reliability of the capping. Furthermore, even in a case where the elevating device 64 moves the maintenance cap 63 to the direction of separating it from the recording head 29, the moisturizing cap 53 is separated from the recording head 29 as guided by the guide rod 54 along with the maintenance cap 63. Therefore, the shift of the moisturizing cap 53 when it is located at the interference position is again suppressed, making it possible to reduce the movement error between the interference position and the non-interference position by the belt-like plate 52 and the pinion 56.

(16) In a case where printing for the continuous sheet 13 is performed, the spatial region 67 of the maintenance cap 63 receiving the maintenance device 68 is kept airtight by the moisturizing cap 53. Therefore, it is possible to suppress drying of the ink attached to the cap member 69 and the wiper member 70 that constitute the maintenance device 68, and to thereby perform satisfactory cleaning and wiping of the recording head 29 by the cap member 69 and the wiper member 70.

(17) It is possible to adjust the position of the maintenance device 68, which is configured to have the cap member 69 and the wiper member 70 as main constituents, to be interposed between the two positions of the upper abutting position and the downward separating position, on the basis of the rotation of the rotary shaft 73 axially supporting the cam members 74 to 76 in the maintenance cap 63. In a case where the maintenance device 68 is moved to the upper abutting position, the upper end of the maintenance device 68 becomes projected upward from the opening 62 of the maintenance cap 63. Therefore, if the maintenance cap 63 is moved up to the maintenance position, the maintenance becomes possible by the maintenance device 68 coming into contact with corresponding recording head 29. On the other hand, in a case where the maintenance device 68 moves to the downward separating position, the upper end of the maintenance device 68 is not projected upward from the opening 62 of the maintenance cap 63. Therefore, it is possible to boost up the moisturizing cap 53 from the lower side by the maintenance cap 63 ascending from the moisturizing position to the waiting position.

In addition, the above-mentioned embodiment may be altered as follows.

In the above-mentioned embodiment, a plurality of maintenance devices 68 may correspond to one recording head 29.

In the above-mentioned embodiment, the maintenance device 68 may be configured to be composed of either only one of the cap member 69 or the wiper member 70. In addition, the maintenance device 68 may further include other mechanisms such as a movable flushing box in addition to the cap member 69 and the wiper member 70.

In the above-mentioned embodiment, the cam motor 80 may be mounted in the maintenance cap 63, and may move up and down along the maintenance cap 63 with the driving of the elevating device 64. That is, the driving gear 82 and the driven gear 78 may maintain the engagement state constantly.

In the above-mentioned embodiment, the driving gear 82 axially supported by the output shaft 81 of the cam motor 80 may be fixably disposed in a position where it is capable of being engaged with the driven gear 78 axially supported by the power transmission shaft 77, which moves up and down together with the maintenance cap 63, when the maintenance cap 63 is moved to the upward position of the maintenance position and the like by the driving of the elevating device 64.

In the above-mentioned embodiment, maintenance device groups 72*a* to 72*c* may be moved up and down by an elevating mechanism such as a jack and the like provided individually for each of the maintenance device groups 72*a* to 72*c*.

In the above-mentioned embodiment, the maintenance cap 63 may not include the atmosphere opening hole 89 and the atmosphere opening valve 90. In this case, when the moisturizing liquid is supplied under pressure to the inside of the spatial region 67 of the maintenance cap 63, maintenance cap 63 may be moved down so that the opening 62 of the maintenance cap 63 is not covered by the moisturizing cap 53.

In the above-mentioned embodiment, the spatial region 67 may be opened to the atmosphere at the supply time of the moisturizing liquid by driving the elevating device 64 to move the maintenance cap 63 down and thereby to bring the opening 62 into the open state.

In the above-mentioned embodiment, the moisturizing liquid may also be supplied into the moisturizing cap 53.

In the above-mentioned embodiment, the moisturizing cap 53 may surround at least one recording head 29 individually. That is, a partition wall may be formed in a position, which is continuous with the peripheral wall portion 59 in the spatial region 61 and corresponds to the space between the recording heads 29. And, the peripheral wall portion 59 and partition wall may be used as a moisturizing cap group corresponding to each recording head 29. In addition, a moisturizing cap group may be provided on the substrate portion 58 so as to be in a position state corresponding individually to each of the recording heads 29. The moisturizing liquid may be supplied to the inside of each moisturizing cap constituting the moisturizing cap group.

In the above-mentioned embodiment, the nozzle forming surface 31 may be surrounded by bringing the maintenance cap 63, which supplies the moisturizing liquid to and retains it in the spatial region 67 at the time of power supply off, into contact with the support plate 28. In this case, the moisturizing cap 53 is moved to the non-interference position.

In the above-mentioned embodiment, the moisturizing unit 50 may not include the guide rod 54 as a guide portion.

In the above-mentioned embodiment, a fluid ejecting apparatus has been embodied as the ink jet type printer 11. However, a fluid ejecting apparatus and a liquid ejecting apparatus may be adopted which eject or discharge fluids and liquids other than ink. For example, various types of liquid ejecting apparatus may be used, which include a liquid ejecting head that discharges minutely small amounts of droplets and the like. In addition, the droplets refer to the liquid state discharged from the above-mentioned liquid ejecting apparatus, and include those of a granular shape, a tear-like shape and a dragged thread-like shape. In addition, the liquid herein may be a material that is likely to be ejected by a liquid ejecting apparatus. For example, the material may be those of the liquid state, and includes a liquid body of high or low viscosity, sol, gel water, other inorganic solvents, organic solvents, a solution, a liquid resin, flowing state such as a liquid metal (metal melt), or the liquid as one of the states of a material, and also those in which particles of a functional material composed of solid substances such as pigments, metallic particles and the like, are dissolved, dispersed or mixed in a solvent, and the like. In addition, typical examples of the liquid include the ink as described in the above-mentioned embodiment, liquid crystal and the like. Herein, the ink includes general aqueous ink, oily ink, and various types of a liquid composition such as gel ink, hot melt ink and the like. Specific examples of the liquid ejecting apparatus include, for example, a liquid ejecting apparatus that ejects liquid including materials such as electrode materials, color materials and the like, which are used in the manufacture of a liquid crystal display, an EL (electroluminescence) display, a surface-emitting display, a color filter and the like, in the form of a dispersion or solution; a liquid ejecting apparatus that ejects a bioorganic substance used in the manufacture of a biochip; a liquid ejecting apparatus that ejects liquid that is a sample used in a precision pipette; a printing device; a microdispenser; and the like. Furthermore, the liquid ejecting apparatus that may be adopted includes a liquid ejecting apparatus that ejects a lubricant with a pinpoint to a precision machinery such as a watch, glass and the like; a liquid ejecting apparatus that ejects transparent resin liquid such as an ultraviolet curing resin and the like on a substrate to form a micro-hemispherical lens (optical lens) and the like used in an optical communication element; and a liquid ejecting apparatus that ejects an etchant such as an acid, an alkali and the like to etch a substrate and the like. The invention may be applied to any one kind of these liquid ejecting apparatuses.

What is claimed is:

1. A fluid ejecting apparatus comprising:

a fluid receptor that receives fluid;

a moisturizing liquid receptor that receives moisturizing liquid;

a fluid ejecting head that ejects the fluid supplied from the fluid receptor from nozzles formed on a nozzle forming surface;

a cap device that has a spatial region becoming airtight by an opening being covered by another member, and is capable of retaining the moisturizing liquid supplied from the moisturizing liquid receptor within the spatial region; and a pressurizing mechanism that leads out the fluid from the inside of the fluid receptor toward the fluid ejecting head and leads out the moisturizing liquid from the inside of the moisturizing liquid receptor toward the inside of the spatial region of the cap device by applying pressure to the fluid receptor and the moisturizing liquid receptor, wherein the cap device has an overflow hold making the moisturizing liquid flow out to the outside of the cap device, when a liquid level of the moisturizing liquid retained within the spatial region becomes equal to or greater than the height of a predetermined threshold liquid level on the basis of the supply from the moisturizing liquid receptor, and wherein the fluid ejecting apparatus includes a moisturizing liquid supply channel capable of supplying the moisturizing liquid from the moisturizing liquid receptor into the spatial region, a moisturizing liquid discharge channel is branched off from midway in the moisturizing liquid supply channel, and the downstream end of the moisturizing liquid discharge channel communicates with the overflow hole.

2. A fluid ejecting apparatus comprising:

a fluid receptor that receives fluid;

a moisturizing liquid receptor that receives moisturizing liquid;

a fluid ejecting head that ejects the fluid supplied from the fluid receptor from nozzles formed on a nozzle forming surface;

a cap device that has a spatial region becoming airtight by an opening being covered by another member, and is capable of retaining the moisturizing liquid supplied from the moisturizing liquid receptor within the spatial region; and a pressurizing mechanism that leads out the fluid from the inside of the fluid receptor toward the fluid ejecting head and leads out the moisturizing liquid from the inside of the moisturizing liquid receptor toward the inside of the spatial region of the cap device by applying pressure to the fluid receptor and moisturizing liquid receptor, wherein the cap device receives a maintenance device that maintains the fluid ejecting head in a disposition state where the maintenance device is enclosed in the spatial region, when the opening of the cap device is covered by the another member, wherein the cap device includes a first cap device having a first spatial region that becomes airtight by the opening being covered by the fluid ejecting head or a support supporting the fluid ejecting head, and a second cap device that has a second spatial region becoming airtight by the opening being covered by the first cap device, and the maintenance device is received in the second spatial region of the second cap device.

3. The fluid ejecting apparatus according to claim 1, the cap device further includes an atmosphere opening hole that makes an atmosphere and the spatial region becoming airtight by the opening be covered by the another member communicate with each other, and an atmosphere opening valve that blocks the atmosphere opening hole to switch the communication between the spatial region and the atmosphere, the atmosphere opening valve is in an open valve state where the spatial region and the atmosphere are allowed to communicate with each other when the moisturizing liquid is supplied to the cap device by applying pressure to the moisturizing liquid receptor by the pressurizing mechanism, and is in a closed valve state where the spatial region and the atmosphere are blocked when the moisturizing liquid is not supplied.

* * * * *